United States Patent [19]

Nakajima et al.

[11] 4,020,616

[45] May 3, 1977

[54] PAPER SHEETS PROCESSING APPARATUS

[75] Inventors: Shunichi Nakajima, Yokohama; Yoshiro Hashimoto, Tokyo, both of Japan

[73] Assignee: Tokyo Shibaura Electric Co., Ltd., Kawasaki, Japan

[22] Filed: July 2, 1976

[21] Appl. No.: 702,357

[30] Foreign Application Priority Data

July 8, 1975 Japan ..... 50-83741

[52] U.S. Cl. ..... 53/54; 53/59 R; 53/159; 53/198 R; 209/111.7 R

[51] Int. Cl.[2] ..... B65B 57/10; B65B 13/12

[58] Field of Search ..... 53/54, 59 R, 159, 198 R; 209/111.7 R

[56] References Cited

UNITED STATES PATENTS

| | | | |
|---|---|---|---|
| 2,570,288 | 10/1951 | Todd | 209/111.7 R |
| 3,849,968 | 11/1974 | Tateisi | 53/54 |

*Primary Examiner*—Travis S. McGehee
*Attorney, Agent, or Firm*—Cushman, Darby & Cushman

[57] ABSTRACT

A paper sheets processing apparatus is provided with a draw-out and conveyance section for drawing out one by one a paper sheet from the paper sheets arranged in a laminated state and conveying said paper sheet, a detection section for detecting each of the paper sheets conveyed thereto to discriminate whether or not it is a normal sheet, or is a soiled sheet, and a reception and pile-up section for receiving and piling up each of the paper sheets thus discriminated in accordance with the detected results of the detection section. The apparatus is further provided with a means for separating normal sheets in units of a prescribed number of sheets to pile up them, a means for supplying a bundling member for bundling each unit of the normal sheets piled up in units of said prescribed number of sheets, and a means for bundling this normal sheet unit by said bundling number. The bundling means includes a pair of roller groups each having at least two rollers, a rotation mechanism for permitting rotation of each roller about the axis thereof, and an integral revolution mechanism for permitting an integral revolution of the roller groups, whereby the normal sheet unit is sandwiched between the roller groups in accordance with the rotating action and the roller groups are integrally revolved, in accordance with the revolving action, with the normal sheet unit sandwiched between the roller groups, thereby to wind the bundling member about the normal sheet unit a prescribed number of times.

14 Claims, 26 Drawing Figures

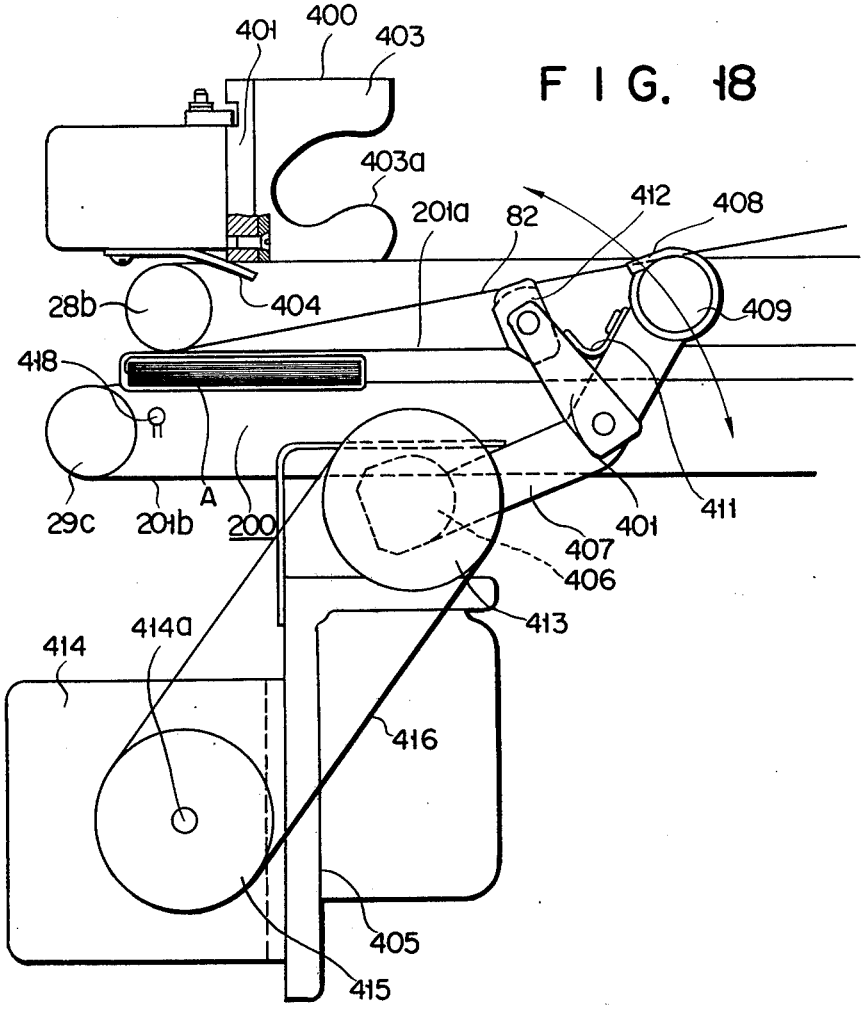
FIG. 18
FIG. 20
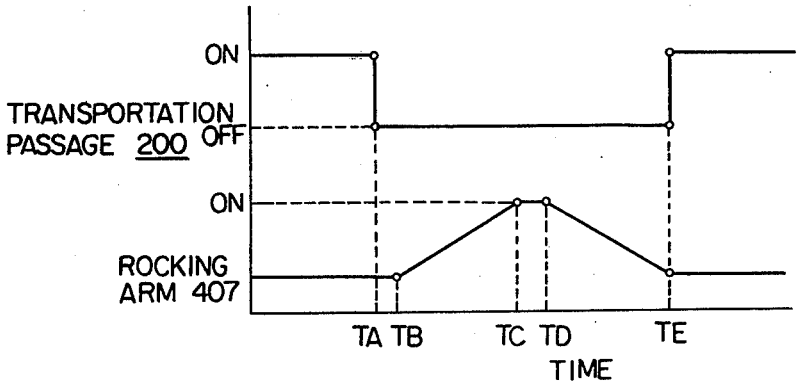

PAPER SHEETS PROCESSING APPARATUS

This invention relates to a paper sheets (such as bank notes, checks, share-certificates, or advice slips) processing apparatus, and more particularly to a paper sheets processing apparatus for permitting each of paper sheets to be received and piled up in accordance with the result of detection as to whether or not it is a normal sheet, or is a soiled sheet, or is an unidentifiable sheet and successively subjecting the paper sheets received and piled up to necessary processing.

A sorting machine for sorting normal paper sheets (which are defined to mean the ones laminated with their sheet front directed in a specified direction) and soiled paper sheets (which are defined to mean the ones laminated with their sheet back directed in said specified direction) from a group of paper sheets (which in this specification means, for example, a bank notes group, a checks group, a share-certificates groups, or an advice slips group), i.e., a group of laminated paper sheets, a counting machine for counting the normal paper sheets and soiled paper sheets as above sorted respectively, and a bundling machine for bundling by means of, for example, a paper tape the normal paper sheets or the soiled paper sheets separated in units of a prescribed number of sheets are being exploited. However, each of these conventional machines is a single purposed machine, which fails to provide a sufficient labour reduction effect. The paper sheets such as bank notes are soiled or damaged since the frequency with which they are used is high and therefore are required to be discriminated into soiled notes incapable of being reused and normal notes capable of being reused. Upon discrimination of the paper sheets into normal sheets and soiled sheets, they sometimes further contain those paper sheets which are identifiable neither into normal sheets nor into soiled sheets, and which here in this specification are each hereinafter referred to as an "unidentifiable sheet". In an automatic paper sheets processing apparatus, the paper sheets should first be discriminated into normal sheets, soiled sheets and unindentifiable sheets to be received and piled up, respectively. Further, at least the normal sheets are preferably separated in units of a prescribed number of sheets to be received and piled up. Furthermore, the normal sheets received and piled up in units of said prescribed number of sheets are preferably successively bundled for each unit and taken out to more increase a labour reduction effect.

Accordingly, it is the object of the invention to provide a paper sheets processing apparatus designed to permit each of paper sheets to be discriminated at least into a normal sheet or a soiled sheet to be received and piled up and simultaneously to permit at least the discriminated normal sheets to be separated in units of a prescribed number of sheets to be received and piled up and successively bundled for each unit.

A paper sheets processing apparatus comprises a drawout and conveyance section for drawing out one by one and conveying the paper sheets supplied thereto in a laminated state, a detection section provided at a terminal end of the draw-out and conveyance section to detect each of said paper sheets conveyed, thereby to discriminate it into a normal sheet, or a soiled sheet, a reception and pile-up section for permitting each of the discriminated paper sheets to be piled up in a corresponding one of reception and pile-up boxes through a gate, and a separator means for separating the discriminated normal sheets in units of a prescribed number of sheets to permit them to be received and piled up for each unit in a normal sheet box, a means for supplying a bundling member for bundling each unit of the normal sheets piled up in units of said prescribed number of sheets, and a bundling means including a pair of roller groups each having at least two rollers, a rotation mechanism for permitting rotation of each roller about the axis thereof, and an integral revolution mechanism for permitting an integral revolution of the roller groups, whereby the normal sheet unit is sandwiched between the pair of roller groups and conveyed by means of the rotation mechanism, and is wound thereabout with the bundling member a prescribed number of times by means of the integral revolution mechanism.

According to the invention, a detection means for detecting whether or not each of the paper sheets is a normal sheet, or is a soiled sheet, or is an unidentifiable sheet, a means for separating at least the discriminated normal sheets in units of a prescribed number of sheets to permit them to be piled up for each unit, and a sealing means for sealing each unit of the normal sheets piled up in units of said prescribed number of sheets are successively provided in the order mentioned, whereby the apparatus can be made compact in construction and simultaneously a large number of paper sheets can be processed with high efficiency.

This invention can be more fully understood from the following detailed description when taken in conjunction with the accompanying drawings in which:

FIG. 18 is a perspective view for explaining the cutting action of the paper tape cutting section;

FIG. 20 is a chart showing the timing relation between the driving operation of the conveyance passage, and the driving operation of the rocking arm, of FIG. 19.

Figure 1A:
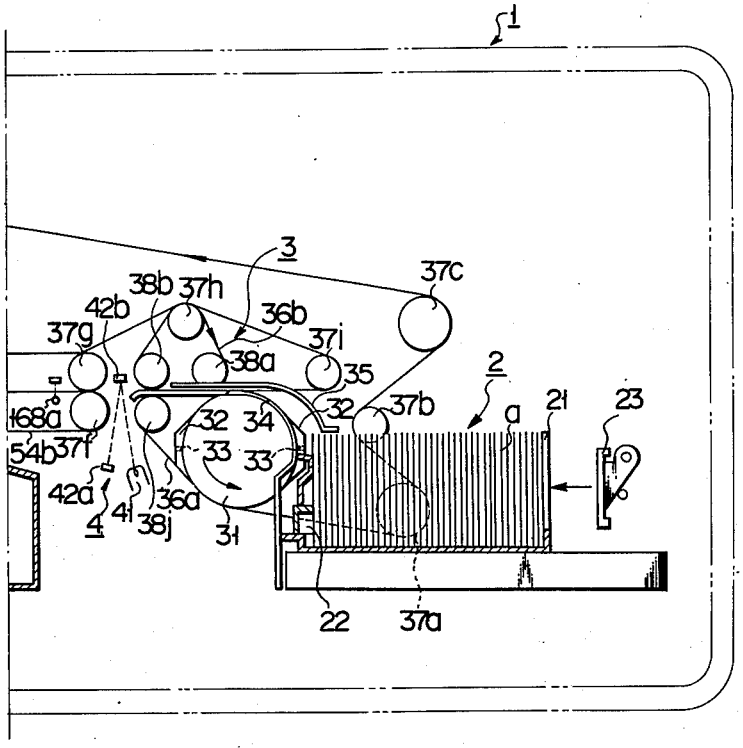
FIGS. 1A and 1B are a side view showing the outline of a paper sheets processing apparatus according to an embodiment of the invention.
Figure 1B:
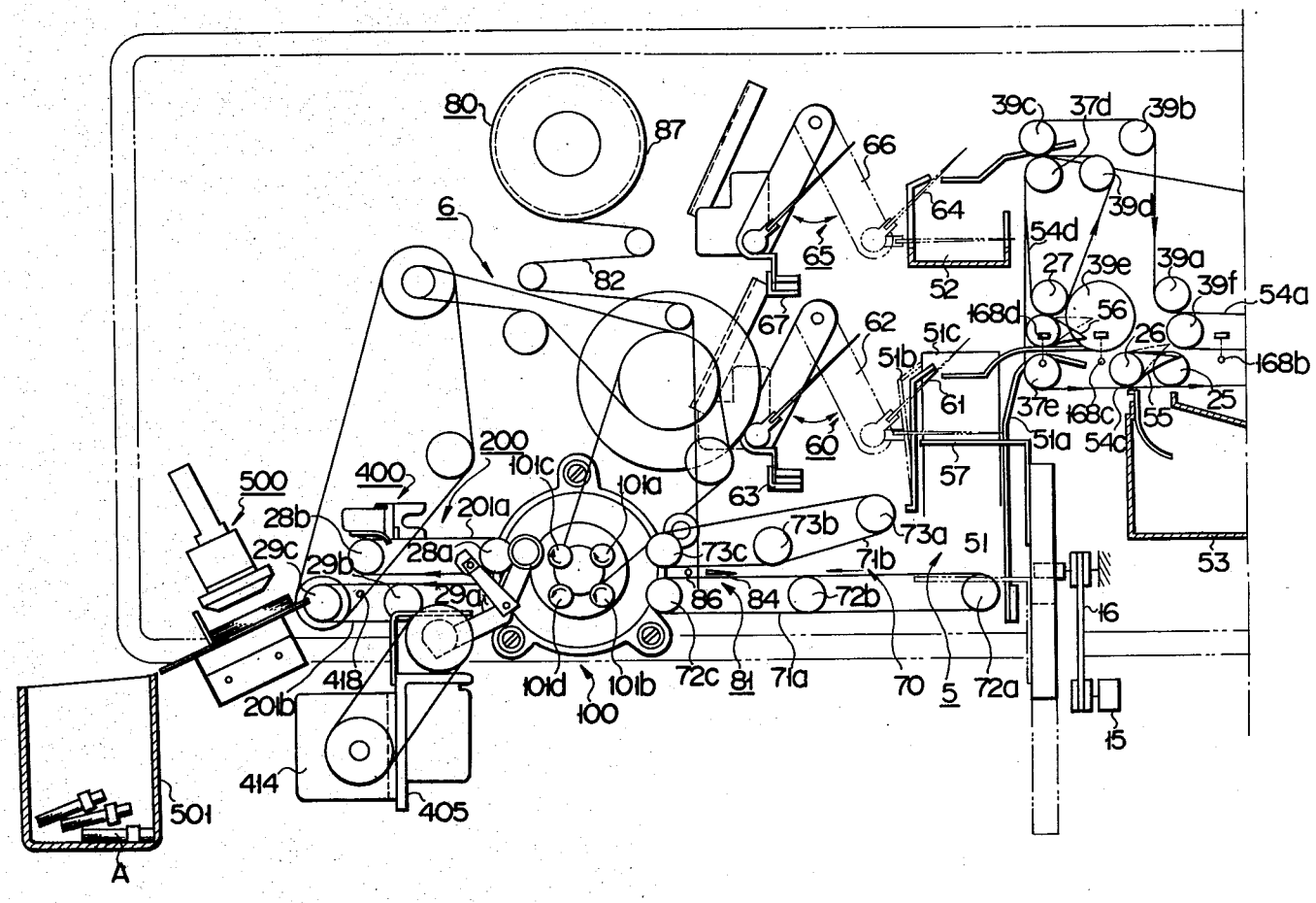

Referring to FIGS. 1A and 1B, a main body 1 of a paper sheets processing apparatus according to the invention includes a paper sheet supply section 2 for supplying a number of paper sheets in a state wherein they are erected and successively arranged in side-by-side relation to each other, a draw-out and conveyance section 3 for drawing out by adsorption a foremost one of said successively arranged paper sheets one by one and conveying the same, a detection section 4 for detecting each of the paper sheets conveyed thereto in sequence to discriminate it into any one of three types of normal sheet, soiled sheet and unidentifiable sheet, a reception and pile-up section 5 for permitting each paper sheet to be received, in accordance with the detected result of the detection section 4, in a corresponding reception and pile-up box a normal sheet separator means 60 for separating the normal sheets in units of a prescribed number of sheets for reception and pile-up thereof in a normal sheet reception and pile-up box, a normal sheet unitsealing means 6 for sealing each unit of the separated, received and piled up normal sheets (which is hereinafter referred to as "normal sheet unit"), and a soiled sheet separator means 65 for separating the soiled sheets in units of a prescribed number of sheets for reception and pile-up thereof in a soiled sheet reception and pile-up box.

The paper sheet supply section 2 includes a paper sheet supply plate 21 constructed by bending a thin plate into a frame-like configuration to supply a paper sheet *a*, an elastic member 22 provided at an opening section (the left end of the illustration) of the sheet supply plate 21 to elastically urge a foremost paper sheet (the left end of the illustration), and a supporting member 23 for urging and supporting a rearmost paper sheet (the right end of the illustration), said supporting member 23 being movable by a spring (not shown) in a direction indicated by an arrow.

The draw-out and conveyance section 3 includes a hollow cylindrical rotor 31 communicating with a vacuum source (not shown), a pair of adsorption members 32 provided on mutually opposite outer peripheral wall portions of the rotor 31, respectively, a plurality of grooves (not shown) provided for each adsorption member along the rotation direction of the rotor 31, and adsorption apertures 33 each bored through an adsorption element (not shown) defined between two adjacent of the grooves. The section 3 further includes a comb-tooth like ordering plate 34 whose tooth portions are fitted into said grooves of the adsorption member, respectively and which extends up to the detection section 4, and a guide plate 35 provided above the ordering plate 34 at an appropriate distance therefrom to guide a drawn-out sheet along the ordering plate 34 up to the detection section 4. The drawout rotor 31 is driven in an arrow-indicated direction by a belt 36*a* stretched over the rotor 31 and rollers 37*a* to 37*j*. A belt 36*b* is driven by rollers 37*h*, 38*a* and 38*b* in an arrow-indicated direction. Therefore, each drawn-out sheet is sandwiched between the belts 36*a* and 36*b* and conveyed up to the direction section 4.

Figure 2:
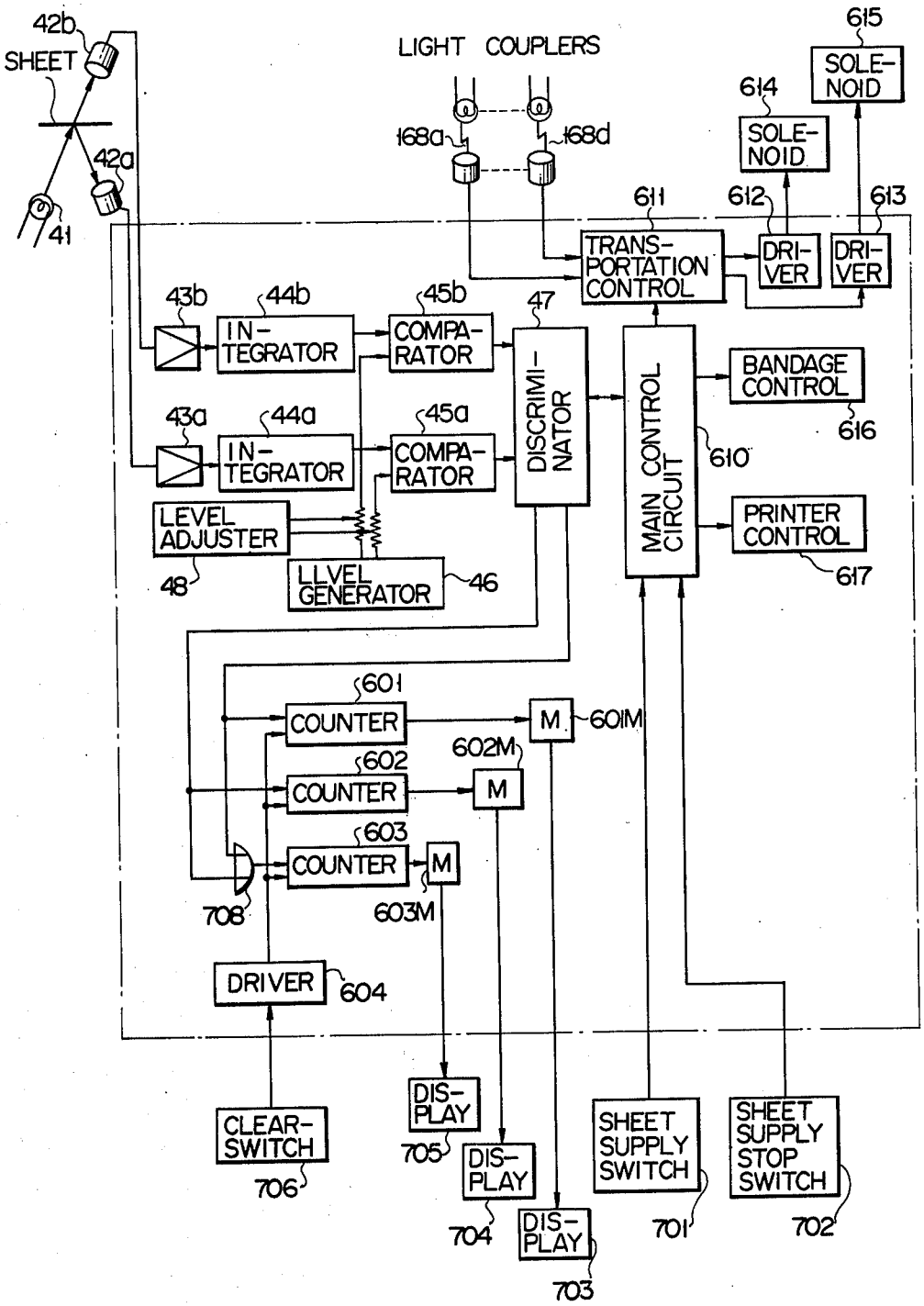
FIG. 2 is a block diagram showing the connection relation between a detection section of the apparatus shown in FIGS. 1A and 1B and a drive and control section thereof.

The detection section 4 is provided at a terminal end of the draw-out and conveyance section 3 in a manner adjacent thereto, and is designed to detect whether or not each paper sheet passing through the section 4 is a normal sheet, or is a soiled sheet, or is an unidentifiable sheet. Namely, the section 4 includes a light source 41 provided on one side of the paper sheet passing through the section 4, a reflected light receiver 42*a* for receiving a light reflected from the paper sheet, and a transmitted light receiver 42*b* provided on the other side of the paper sheet passing through the section 4 to receive a light transmitted through the paper sheet. As shown in FIG. 2, the signals from the light receivers 42*a* and 42*b* are supplied to integrators 44*a* and 44*b* through amplifiers 43*a* and 43*b*, respectively, and are integrated therein. Respective integrated voltage signals from the integrators 44*a* and 44*b* are supplied to one side-inputs of the comparators 45*a* and 45*b*, respectively. Supplied to the other side-inputs of the comparators 45*a* and 45*b* are the output reference signals from a reference level generator 46 which have levels so set beforehand as to correspond to a specified normal sheet and a specified soiled sheet, respectively. These reference levels can be adjusted to a desired value by operation of a reference level adjusting switch 48. A discriminator circuit 47 is designed to discriminate, upon receipt of the signals from the comparators 45*a* and 45*b*, whether or not each paper sheet passing through the detection section 4 is a normal sheet, or is a soiled sheet or is an unidentifiable sheet, to produce two types of discrimination signals denoting the normal sheet and the soiled sheet, respectively.

The reception and pile-up section 5 is designed to permit the normal sheet, soiled sheet and unidentifiable sheet discriminated by the detection section 4 to be separately received and piled up in a normal sheet box 51, a soiled sheet box 52 and an unidentifiable sheet box 53, respectively. A belt 54*a* stretched over the rollers 37*g*, 39*a* to 39*f* is driven in a direction indicated by a shown arrow, a belt 54*b* stretched over the rollers 37*f* and 25 is driven in a direction indicated by a shown arrow, a belt 54*c* stretched over the rollers 37*e* and 26 is driven in a direction indicated by a shown arrow, and a belt 54*d* stretched over the rollers 37*d*, 39*d* and 27 is driven in a direction indicated by a shown arrow. Accordingly, each discriminated paper sheet is sandwiched between the belts 54*a* and 54*b* and conveyed. The unidentifiable sheet is received and piled up in the unidentifiable sheet box 53 by counterclockwise swing of a gate 55, while the normal sheet, after further conveyed, is received and piled up in the normal sheet box 51 by counterclockwise swing of a gate 56. On the other hand, the soiled sheet is guided by clockwise swing of a gate 56 upwardly of the illustration and is further conveyed upwards by being sandwiched between the belts 54*a* and 54*b* to enter the soiled sheet box 52. Provided for the conveyance passage between the rollers 37*f* and 25 are light couplers 168*a*, 168*b*. Provided for the conveyance passage between the rollers 26 and 37*e* are light couplers 168*c*, 168*d*. Upon passage of the paper sheets through these conveyance passages, the above-mentioned gates are controlled in accordance with the detection signals from those light couplers. On the right side of the illustrated normal sheet box 51 is provided a stationary wall 51*a* formed with a plurality of longitudinal grooves (not shown), so that an L-shaped back up plate 57 for receiving and piling up thereon the normal sheet may be raised or lowered along said longitudinal grooves. Namely, this backup plate 57 is upwards or downwards driven between illustrated dotted and soiled positions by a belt 16 driven by a motor 15 controlled by a control signal (not shown). Provided for the normal sheet box 51 are vibrators 51*b* and 51*c* for giving vibrations to respective two adjacent side edges of the paper sheets received and piled up on the backup plate 57, thereby to order those side edges vertically.

Figure 7:
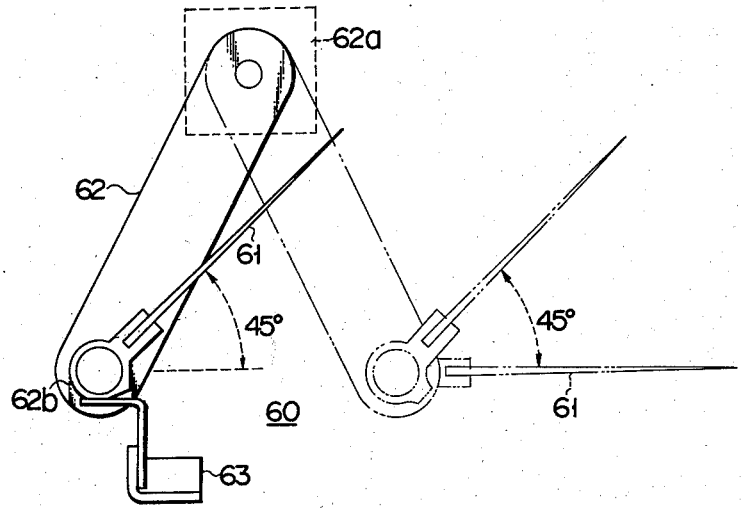
FIG. 7 is an enlarged view showing a reset mechanism of the separation section shown in FIG. 1B.

Provided on the rear side (the left side of the illustration) of the normal sheet box 51 is the above-mentioned normal sheet separator means 60 having a separation lever 61. The separator means 60 further has, as shown in FIG. 7, a rocking arm 62 pivotally supported at one end by a control means 62*a*, said separation lever 61 being attached through a cam 62*b* to a free end of the rocking arm 62. The rocking arm 62 is advanced from an illustrated solid-lined position up to an illustrated dotted position to permit the separation lever 61 to await at a position counterclockwise rocked through an angle of 45° from a horizontal position.

On the backup plate 57 the normal sheets are received and piled up while being counted by a counter (not shown). During this reception and pile-up the backup plate is allowed sequentially to fall. When a prescribed member number of normal sheets, for example, one hundred normal sheets are received and piled up on the backup plate 57, the awaiting separation lever 61 is quickly clockwise rocked through an angle of 45° to be held at the horizontal position, and the 101th and the succeeding normal sheets are piled up on the separation lever 61. During this pile-up operation, the backup plate 57 having the one hundred normal sheets piled up thereon is lowered down to an illustrated dotted position of FIG. 1B. A belt 71*a* stretched over rollers 72*a*, 72*b* and 72*c* forms a conveyance passage 70 together with a belt 71*b* stretched over rollers 73*a*, 73*b* and 73*c*. When the backup plate 57 is lowered down to the illustrated dotted position, a normal sheet unit (for example, a unit of one hundred piled-up paper sheets) on the backup plate is transferred onto the conveyance passage 70. After completion of the normal sheet unit transferring, the movable plate 57 is again driven up to the illustrated solid line-indicated position to receive another unit of paper sheets piled up on the separation lever 61. Since, at this time, the rocking arm 62 is rocked clockwise, the separation lever 61 is retreated leftwardly of the illustration in a state kept at the horizontal position. When the free end of the rocking arm 62 is retreated up to the position of a reset mechanism 63, the separation lever 61 is rocked, as shown in FIG. 7, counterclockwise through an angle of 45° due to a combined action of the reset member 63 and a cam 62*b* to stop at the illustrated solid line-indicated position. Thereafter, the rocking arm 62 is again rocked counterclockwise and thus driven toward the illustrated dotted line-indicated position, and is made ready for another reception of the 301th or succeeding paper sheets.

The soiled sheet box 52 is a frame body formed of a thin plate, and one side (the left side of the illustration) thereof is formed with a plurality of comb-tooth like vertical grooves so that a separation lever 64 of a second separation means 65 having the same construction as that of the separation means 60 stated in connection with the normal sheet box 51 may be rocked through those vertical grooves. The advance and retreat of a rocking arm 66, the operation of the separation lever 64, and a reset mechanism 67 for resetting the separation lever 64 upon retreat of the rocking arm 66, of the separator means 65 are completely the same as those explained in connection with the separator means 60, and therefore explanation thereof is omitted. The above-mentioned unidentifiable sheet box 53 is also a frame body formed of a thin plate and is disposed below the gate 55 at a terminal end of the conveyance passage defined between the belts 54*a* and 54*b*.

The sealing means 6 for sealing said normal sheet unit A (each unit of the normal sheets received and piled up in units of, for example, one hundred sheets) includes: a conveyance passage 70 for receiving the normal sheet unit A piled up on the backup plate 57 to convey it in a direction indicated by a shown arrow; a means 80 for supplying a bundling member for bundling the normal sheet unit A, for example, a reel for supplying the bundling member such as a paper tape, and a paper tape insertion means 81 for inserting a free end of the paper tape 82 into a substantially intermediate portion of the normal sheet unit pile or laminate; a bundling means 100 for receiving the normal sheet unit A having the free end of the paper tape inserted thereinto a bind the normal sheet unit therearound with the paper tape; and a paper tape cutting means 400 for pasting the paper tape thus bound and cutting a desired portion of the paper tape 82 to separate the normal sheet unit from a paper tape supply source. According to the invention, there can be further provided on demand a printer section 500 for printing necessary items on the paper tape of the sealed normal sheet unit bundle.

Figure 3:
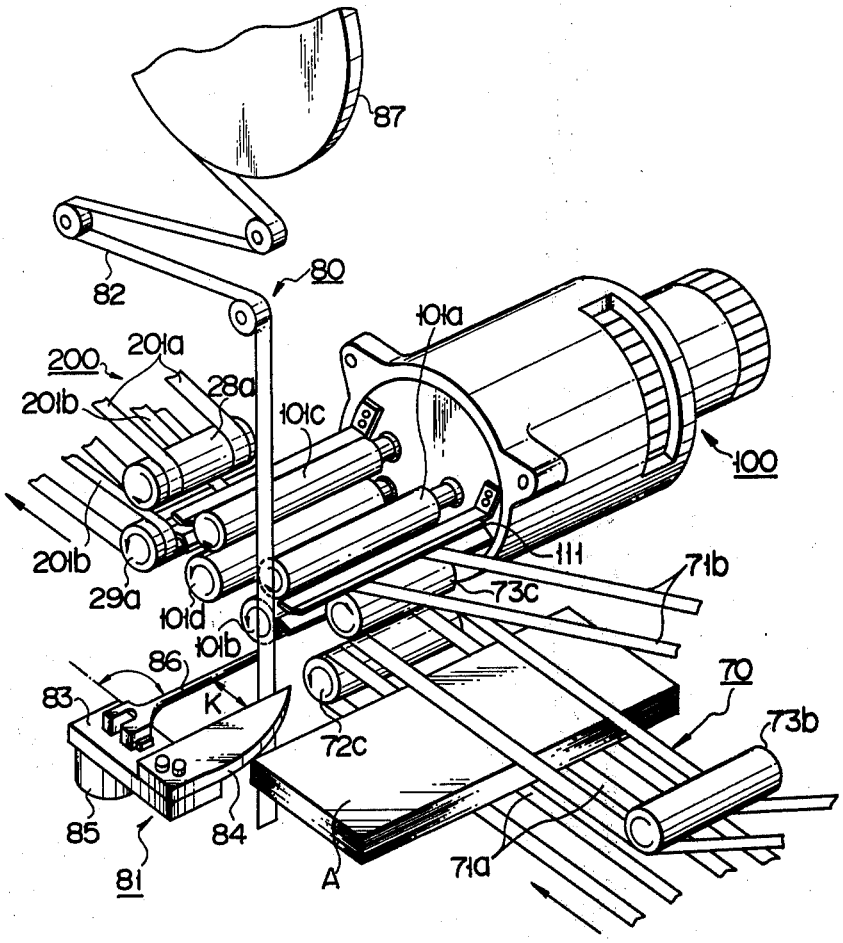
FIG. 3 is a perspective view of a bundling section of the apparatus shown in FIGS. 1A and 1B.

The paper tape insertion means 81 includes a knife edge 84 and a pin member 86 provided on the passage 70 defined between said belts 71*a* and 71*b*. As shown in FIG. 3, the knife edge 84 is disposed on a stationary support bed 83 so as to permit a blade tip thereof to oppose a coming normal sheet unit A, while the pin member 86 is disposed on the same stationary bed so as to permit an interval or interspace K to be defined between the pin member 86 and the knife edge 84. The pin member 86 is rocked by a solenoid 85 substantially through an angle of 90° as indicated by a shown arrow. Above the paper tape insertion means 81 is disposed a reel 87 of the paper tape supply means 80 and the free end of the paper tape 82 is downwardly suspended through the interspace K. Namely, the free end of the paper tape is so suspended as to await the passage of the normal sheet unit A.

Figure 4A:
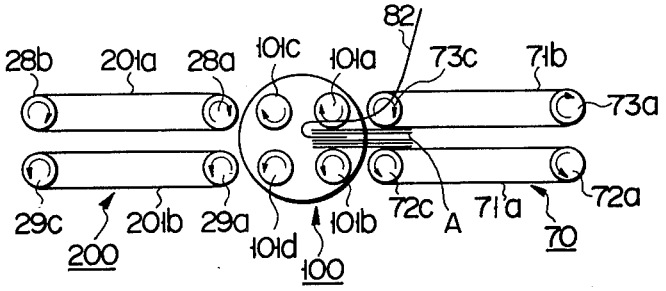
FIGS. 4A to 4C are views for explaining an operative condition of the bundling section shown in FIG. 3.
Figure 4B:
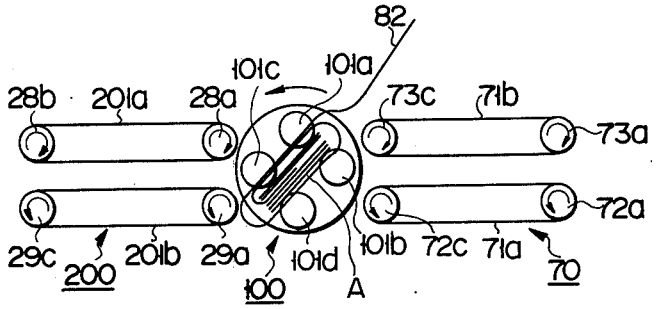
Figure 4C:
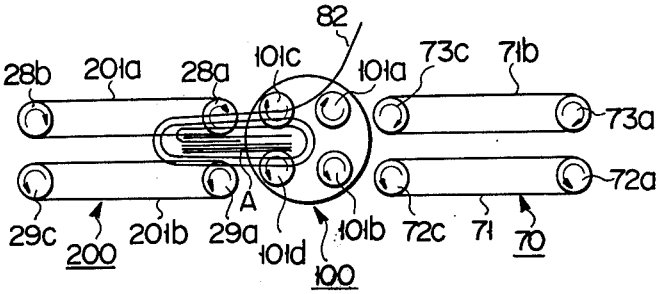
Figure 5:
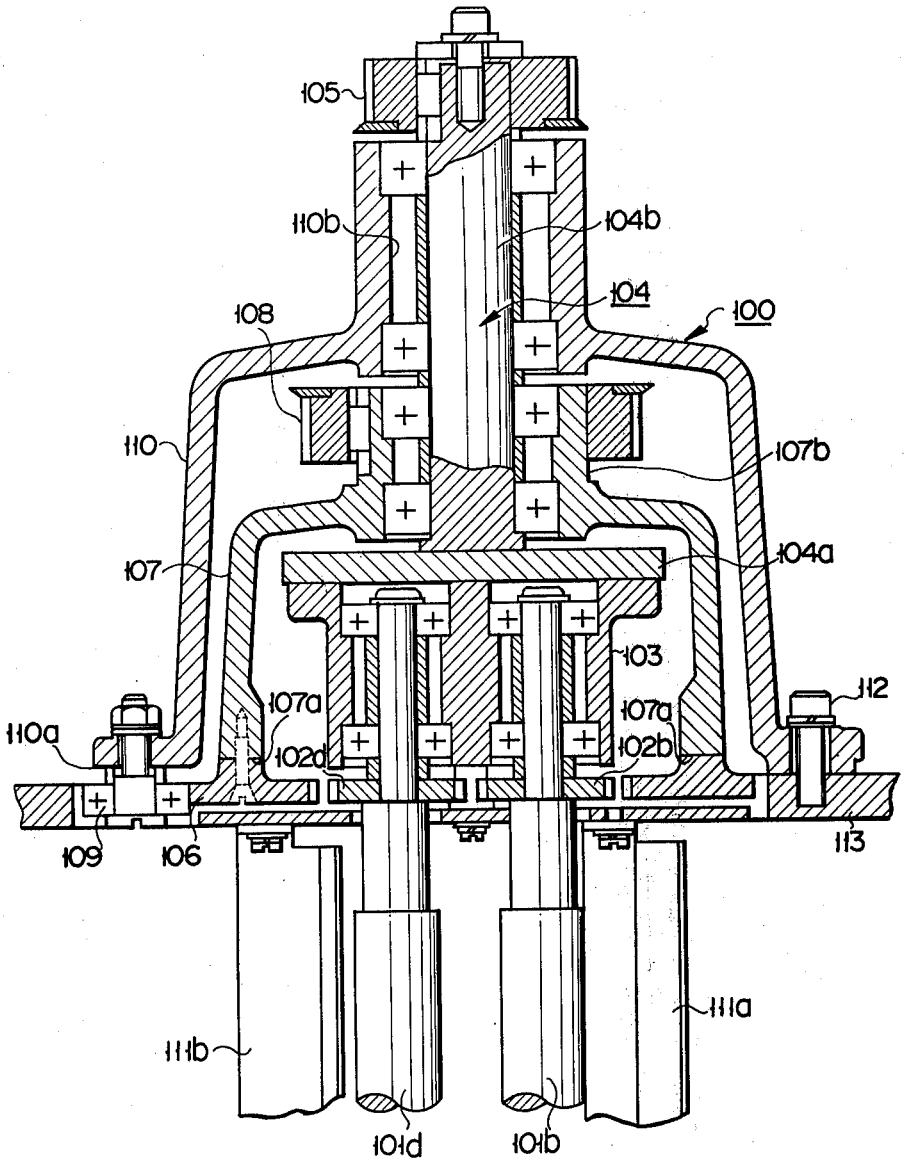
FIG. 5 is a sectional view taken along the V—V line of FIG. 6, for explaining a roller-rotating mechanism and rollerintegrally revolving mechanism of the bundling section shown in FIG. 3.
Figure 6:
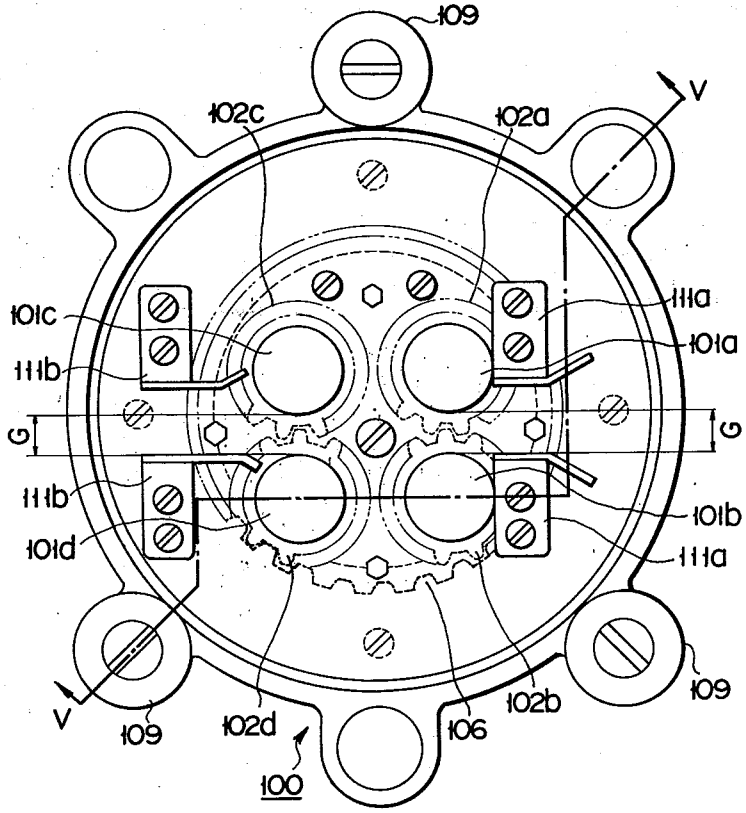
FIG. 6 is a plan view of a lower part of FIG. 5, principally showing the intermeshed relation between gears.

FIGS. 3, 5 and 6 show a construction of the bundling means 100, and FIGS. 4A to 4C are views for explaining the operation of the bundling means 100. The bundling means 100 includes a rotation mechanism for permitting each of, for example four rollers (this invention is not limited thereto) 101*a*, 101*b*, 101*c* and 101*d* to be rotated about its own axis in a direction indicated by a shown arrow, and an integral revolution mechanism for permitting those rollers to be integrally revolved counterclockwise as shown in FIG. 4B. As seen from FIGS. 5 and 6, gears 102*a*, 102*b*, 102*c* and 102*d* are secured to the rotation shafts of the rollers 101*a*, 101*b*, 101*c* and 101*d*, respectively. Those rotation shafts of the rollers are respectively rotatably supported within the support bed 103 (FIG. 5). The gear 102*a* is intermeshed with the gear 102*b*, while the gear 102*c* is intermeshed with the gear 102*d*. A coupling shaft 104 is constructed such that a rotation shaft 104*b* and a board 104*a* are made integral with each other. To this rotation shaft 104*b* is connected a revolution timing pulley 105. Therefore, when this pulley 105 is rotated, the roller support bed 103 is also rotated in accordance herewith. For instance, when the support bed 103 is rotated in a counterclockwise direction as viewed from above FIG. 6, the rollers 101*a*, 101*b*, 101*c* and 101*d* are integrally revolved counterclockwise as indicated by an arrow of FIG. 4B.

Provided is a funnel-shaped inner housing 107 having a large-opening section 107*a* and a small-opening section 107*b*. At this small-opening section 107*b* the inner housing 107 is rotatably supported by the rotation shaft 104*b*. To an outer periphery of the small-opening section 107*b* is connected a rotation timing pulley 108. To the large-opening section is connected an internal gear 106, with which are intermeshed only 1012*b* and 102*d* of said gears 102*a* to 102*d* (see FIG. 6). Accordingly, when the rotation timing pulley 108 is rotated in a counterclockwise direction as viewed from above FIG. 6, the gears 102*b* and 102*d* are rotated counterclockwise to permit a respective clockwise rotation of the gears 102*a* and 102*c* intermeshed with the gears 102*b* and 102*d*. Namely, the rollers 101*a* to 101*d* are respectively rotated in directions indicated by shown arrows of FIGS. 4A and 4C. Provided for the purpose of supporting the rotation shaft 104*b* of the coupling shaft 104 is a funnel-shaped outer housing 110 having a large-opening section 110*a* and a small-opening section 110*b*. The rotation shaft 104*b* is supported at this small-opening section 110*b*. Said inner housing 107 is surrounded by the inner wall of that large-opening section 110*a*. The peripheral edge of the large-opening section 110*a* is fixed to a stationary small member 113 by bolts 112. To the peripheral wall of the large-opening section 110*a* is attached a rotatable roller 109 for preventing the inner housing 107 from being horizontally vibrated upon being rotated. Note that provision is made of a pair of guide members (11*a* for introducing the normal sheet unit A into a gap G between a group of rollers 101*a* and 101*c* and a group of rollers 101*b* and 101*d*, and a pair of guide members 111*b* for drawing out from the gap G the normal sheet unit A bound with the bundling member.

A bundled normal sheet unit A is sent onto a conveyance passage 200. This passage 200 is defined between a belt 201*a* stretched between rollers 28*a*, 28*b* and a belt 201*b* stretched over rollers 29*a*, 29*b* and 29*c*.

Figure 9:
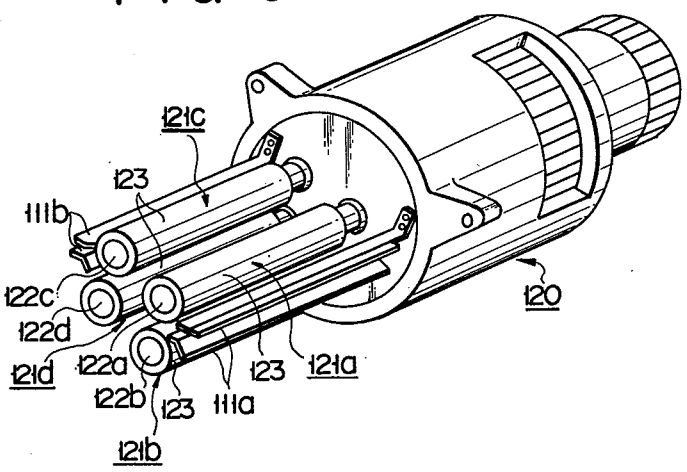
FIG. 9 is a perspective view of a modification of the bundling section shown in FIG. 5.

A modified one 120 of the above-mentioned bundling means 100 is perspectively shown in FIG. 9. The rollers 121*a*, 121*b*, 121*c* and 121*d* shown here in FIG. 9 have their base portions 122*a*, 122*b*, 122*c* and 122*d* coated at the outer periphery with a highly compressible friction material 123 such as rubber or sponge. Accordingly, even if the normal sheet unit A is slightly varied in thickness, it will be able to be reliably bundled during the rotation and integral revolution of the rollers.

Figure 10:
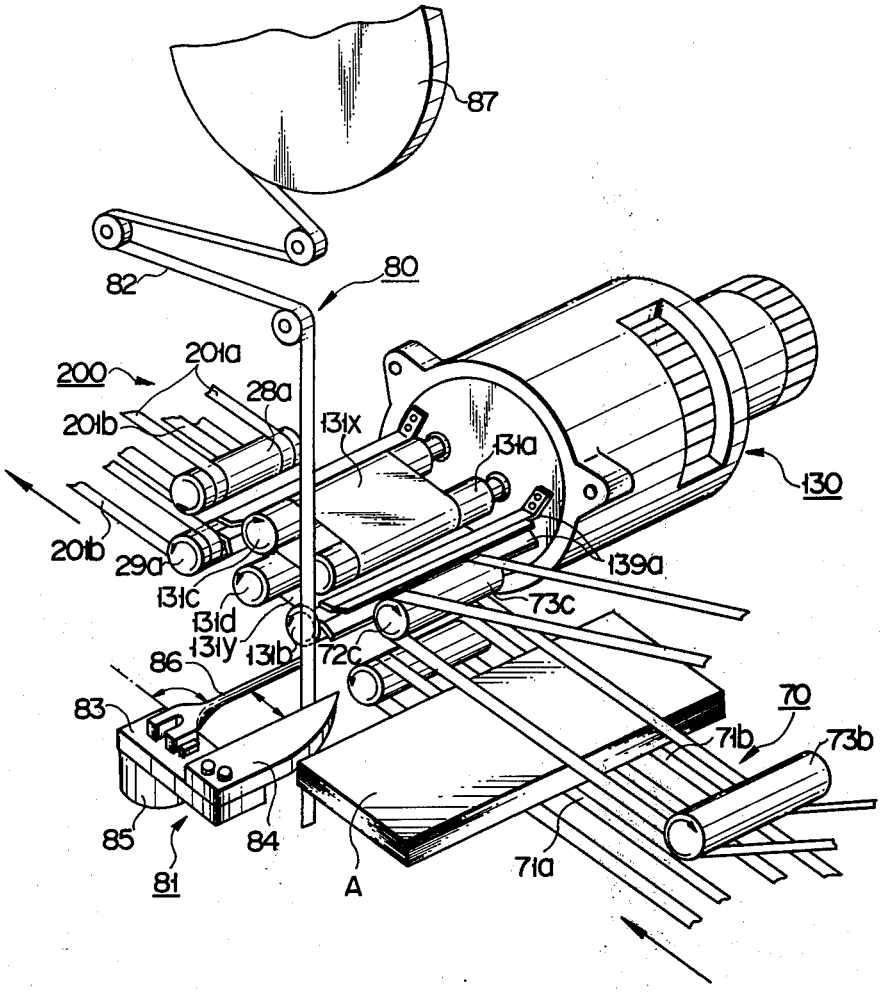
FIG. 10 is a perspective view of another modification of the bundling section shown in FIG. 5.
Figure 11A:
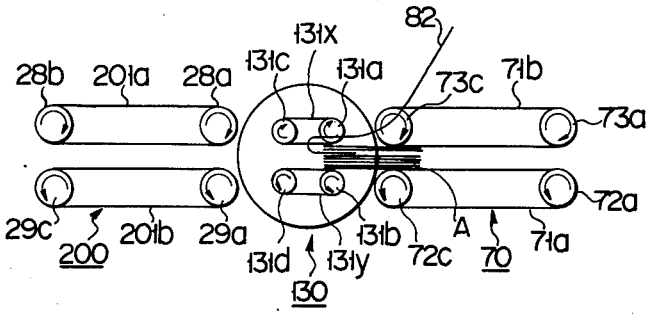
FIGS. 11A to 11C are views for explaining the operation of the bundling section shown in FIGS. 10, 12 and 13.
Figure 11B:
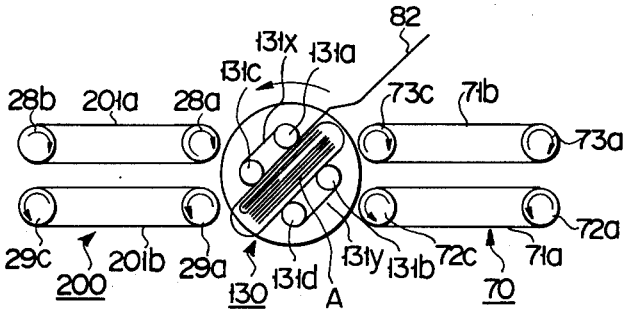
Figure 11C:
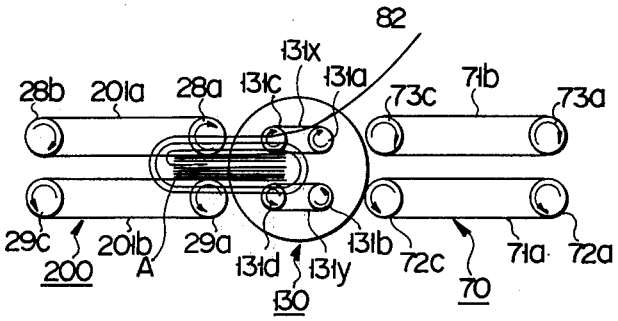
Figure 12:
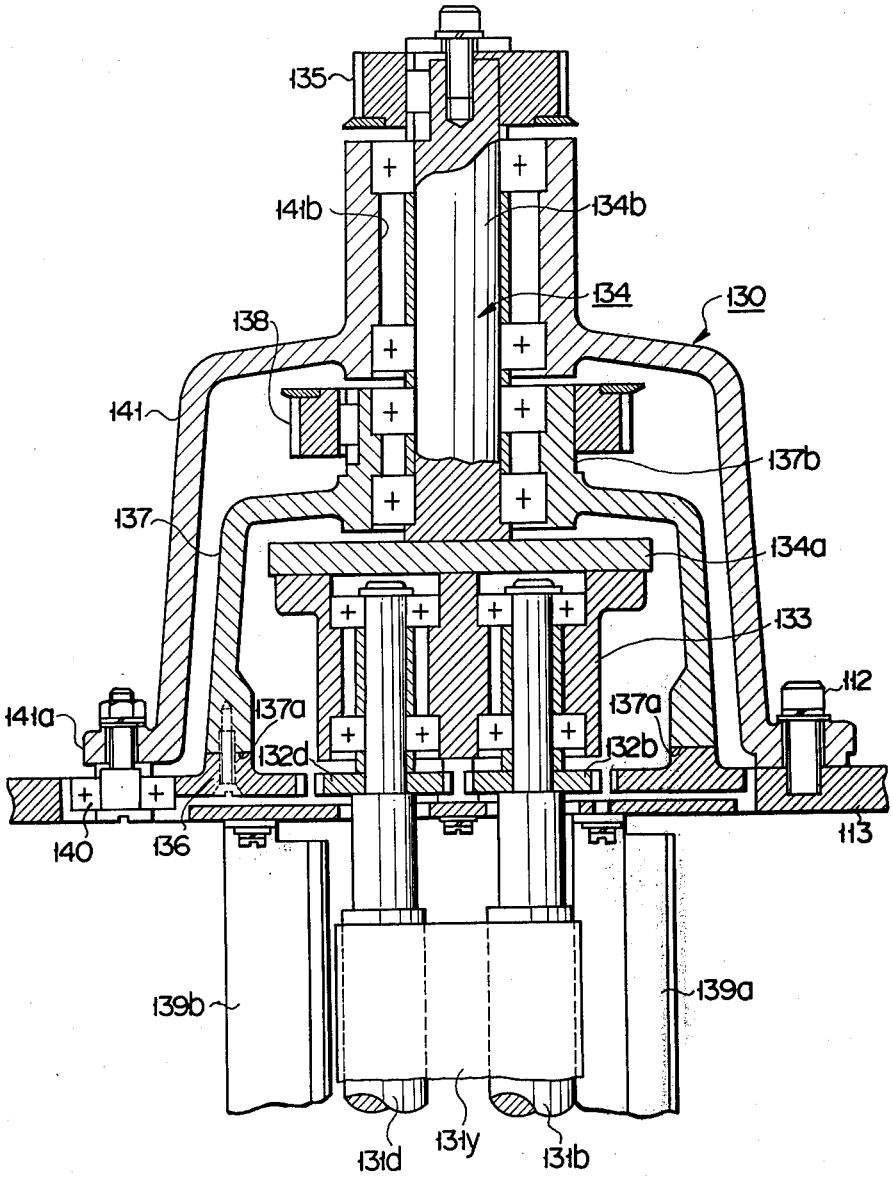
FIG. 12 is a sectional view taken along the line XII—XII of FIG. 13.

Another modified one 130 of the above-mentioned bundling means is shown in FIGS. 10 to 13. To the shafts of rollers 131*a*, 131*b*, 131*c* and 131*d* are integrally fitted gears 132*a*, 132*b*, 132*c* and 132*d* (see FIG. 13), respectively. The gear 132*a* is intermeshed with the gear 132*b*, while the gear 132*c* with the gear 132*d*. As shown in FIG. 12, a coupling shaft 134 is constructed such that a board suction 134*a* is integrally connected to a rotation shaft 134*b*. Below the board section 134*a* a support member 133 for supporting the rotation shafts of the rollers is fixed, and the respective rotation shafts of the rollers are rotatably supported by that support member 133. An integral revolution timing pulley 135 is secured to the rotation shaft 134*b*. Accordingly, when the integral revolution timing pulley 135 is rotated by a belt (not shown) in a counterclockwise direction as viewed from above FIG. 13, this rotation is transmitted to the support member 133 through the coupling shaft 134. Accordingly, the rollers 131*a*, 131*b*, 131*c* and 131*d* supported by the support member 133 are integrally revolved counterclockwise. Namely, a group of the rollers 131*a*, 131*c* having a belt 133*x* stretched therebetween and a group of the rollers 131*b*, 131*d* having a belt 131*y* stretched therebetween are integrally revolved in a direction by an arrow shown in FIG. 11B in a state having the belts 131*x*, 131*y* stretched thereover, respectively.

Figure 13:
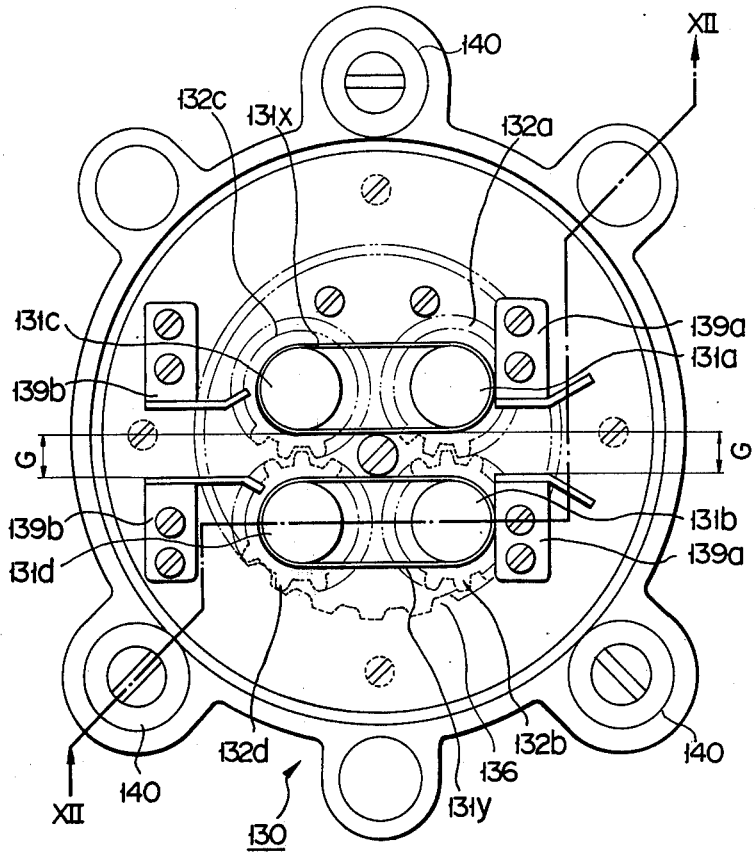
FIG. 13 is a plan view of a lower part of FIG. 12, principally showing the intermeshed relation between gears.

As shown in FIGS. 12 and 13, an internal gear 136 intermeshed with only the gears 132*b*, 132*d* is provided. This gear 136 is fitted to a peripheral edge 137*a* of a large-opening section of a funnel-shaped inner housing 137. To an outer wall 137*b* of a small-opening section of this inner housing 137 is fitted a rotation timing pulley 138. When this pulley 138 is rotated by a belt (not shown), this rotation is transmitted to the internal gear 136 through the inner housing 137. For instance, when the internal gear 136 is rotated in a counterclockwise direction as viewed from above FIG. 13, the gears 132*b* and 132*d* intermeshed with the gear 136 are rotated counterclockwise, respectively, while the gears 132*a* and 132*c* intermeshed with the gears 132*b* and 132*d*, respectively, are rotated clockwise (see FIGS. 11A and 11C). Accordingly, the belts 131*x* and 131*y* are allowed to travel in directions indicated by arrows shown in FIG. 11A, respectively. A reference numeral 139*a* denotes a guide member, which so acts as to introduce the normal sheet unit A from the conveyance passage 70 into an interspace defined between the belts 131*x* and 131*y*, while another guide member 139*b* so acts as to take out the normal sheet unit A from that interspace and introduce it onto the conveyance passage 200. A funnel-shaped outer housing 141 is provided so as to surround the inner housing 137. On a peripheral edge portion 141*a* of the large-opening section of the outer housing 141 is supported a rotatable roller 140, which is allowed slidably to contact the outer peripheral edge of the internal gear 136 to prevent the inner housing 137 from being horizontally vibrated upon being rotated. The peripheral edge of the large-opening section of the outer housing 141 is fixed by bolts 112 to the stationary wall member 13. Said rotation shaft 134*b* for integral revolution of the rollers 131*a*, 131*b*, 131*c* and 131*d* is supported by an inner wall 141*b* of the smallopening section of the outer housing 141. FIG. 11A shows the condition wherein the bundling means 130 is receiving the normal sheet unit A from the conveyance passage 70. FIG. 11B shows the condition wherein the bundling means 130 having the normal sheet unit received therein and sandwiched between the belts 131*x* and 131*y* is integrally revolved and the paper tape 82 is bound around the normal sheet unit. FIG. 11*c* shows the condition wherein the normal sheet unit wound with the paper tape 82 a prescribed number of times is transferred from the bundling means 130 to the conveyance passage 200. FIG. 10 shows the positional relation between the bundling means 130, conveyance passages 70, 200, paper tape insertion section 81 and normal sheet unit A.

Figure 14:
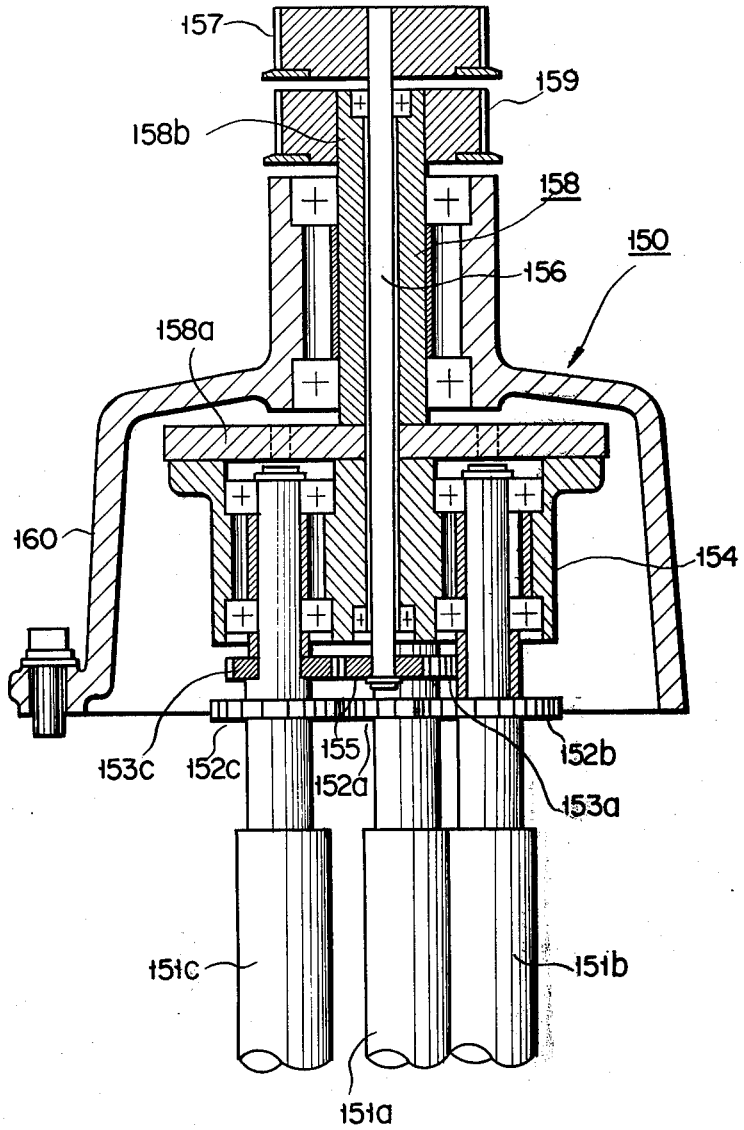
FIG. 14 is a sectional view taken along the line XIV—XIV of FIG. 15 showing still another modification of the bundling section.
Figure 15:
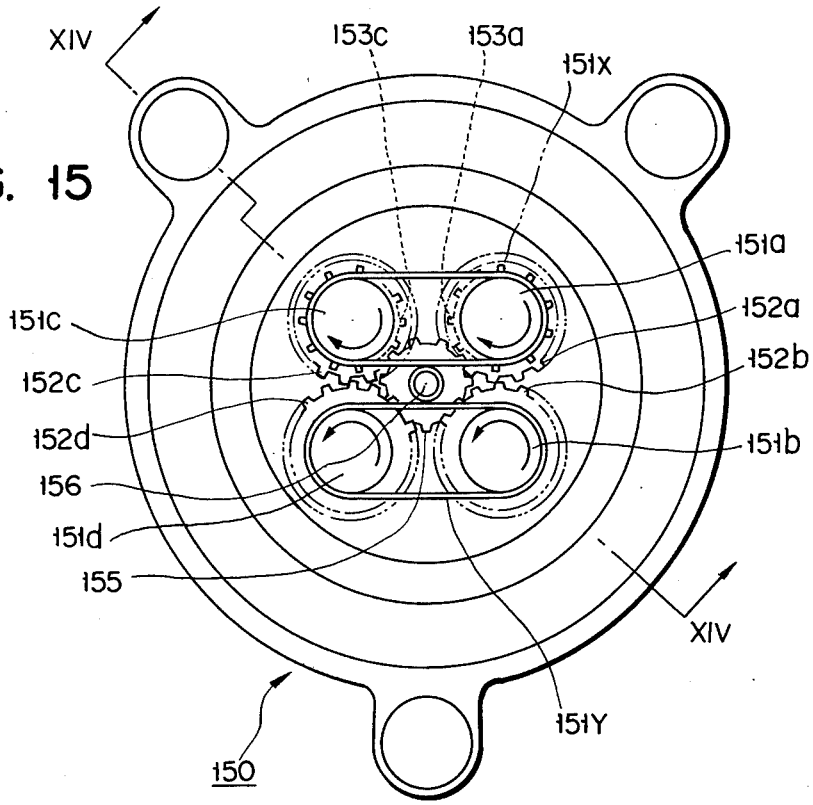
FIG. 15 is a plan view of a lower part of FIG. 14, principally showing the intermeshed relation between gears.

Still another modified one 150 of the bundling means is shown in FIGS. 14 and 15. Referring to FIGS. 14 and 15, gears 152*a*, 152*b*, 152*c* and 152*d* are secured to the shafts of rollers 151*a*, 151*b*, 151*c*, and 151*d*, respectively. The gear 152*a* is intermeshed with the gear 152*b*, while the gear 152*c* with the gear 152*d*. Gears 153*a* and 153*c* separate respectively from the gears 152*a* and 152*c* are further secured to the rollers 151*a* and 151*c*, respectively. The respective shafts of the rollers are rotatably supported by a support member 154. Provided are a board member 158*a* having one end of the support member 154 fixed thereto and that rotation shaft 158*b* for integral revolution of the rollers which is fixed to said board member 158*a*. To the rotation shaft 158*b* is fitted an integral revolution timing pulley 159. A rotation shaft 156 for rotation of the rollers about their respective axes, having a rotation timing pulley 157 fixed at one end, is extended through a coupling shaft 158 and the support member 154 and simultaneously rotatably supported by these members 158, 154, and a free end thereof is extended up to an illustrated position situated upwardly of the gears 152*a* to 152*d*. A gear 155 is fixed to the free end of the rotation shaft 156 so as to be intermeshed with the gears 153*a* and 153*c*. Belts 151*x* and 151*y* are stretched between the rollers 151*a*, 151*c* and between the rollers 151*b*, 151*d*, respectively. The illustration of these belts is omitted from FIG. 14. A large-opening section of a funnel-shaped outer housing 160 is so disposed as to surround the board member 158*a* and the support member 154, and the peripheral edge of the large-opening section is fixed by bolts to a stationary wall member (not shown). The above-mentioned rotation shaft 158*b* is rotatably supported by the inner wall of a small-opening section of the outer housing 160.

When the rotation timing pulley 157 is rotated in a counterclockwise direction as viewed from above FIG. 15, the gear 155 is rotated in a direction indicated by a shown arrow, while the respective gears 153*a*, 153*c* intermeshed with the gear 155 are rotated in a direction indicated by shown arrows (FIG. 15), namely, in a clockwise direction. Since the gears 153*a*, 153*c* are made integral with the gears 152*a*, 152*c*, respectively, and simultaneously the gears 152*a*, 152*c* are intermeshed with the gears 152*b*, 152*d*, respectively, the rollers 151*a*, 151*c* are respectively rotated clockwise and the rollers 151*b*, 151*d* are respectively rotated counterclockwise. Accordingly, the bundling means 150 is capable of receiving the normal sheet unit by rotation of the rollers about their respective axes to permit the normal sheet unit to be sandwiched between the belts 151*x* and 151*y*, and simultaneously is capable of permitting the paper tape 82 to be wound around the sandwiched normal sheet unit by integral revolution of the rollers. In the case of the bundling means 130, the inner housing 137 and the internal gear 136 were used to permit rotation of the rollers about their respective axes. In the case of the bundling means 150, however, corresponding members to those housing 137 and internal gear 136 are not used and the same action as that performed by the bundling means 130 can be performed by additional provision of the rotation shaft 156, gears 153*a*, 153*c* and 155.

Figure 8:
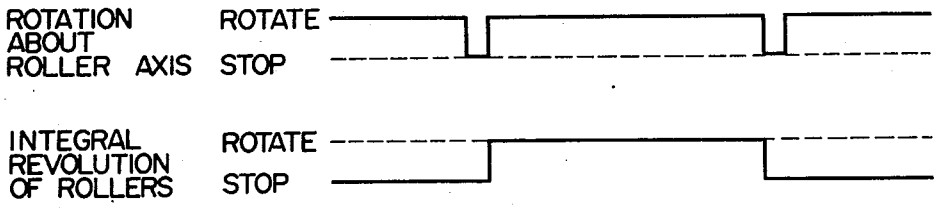
FIG. 8 is a chart showing the timing relation between the rotation and the integral revolution of rollers of the bundling section shown in FIGS. 4, 5 and 6.

FIG. 8 is a timing chart for explaining the operation of, for example, the above-mentioned bundling means 100. This timing chart shows that, upon receiving the normal sheet unit A from the conveyance passage 70, the bundling means 100 once stops the rotation of the rollers 101*a* to 101*d* about their respective axes and then permits an integral revolution of those rollers in order to bind the paper tape 82 around the normal sheet unit. During the integral revolution of the rollers, the bundling means 100 permits the rotation of the rollers about their respective axes in order to keep fixed the positional relation between each of the paired roller groups and the normal sheet unit.

The above-mentioned conveyance passage 200, receives the normal sheet unit A bound with the paper tape 82 by the bundling means 100, or 120, or 130, or 150, to convey it in a direction indicated by a shown arrow. When the normal sheet unit A is conveyed up to a prescribed position of the conveyance passage 200, this conveyance is stopped and at this stop position the pasting of the paper tape 82 and the cutting of the pasted paper tape are effected by the paper tape cutting means 400. As shown in FIGS. 16 to 19, a stationary blade 402 is fitted to a support block 401 provided above the conveyance passage 200. On one side of the stationary blade 402 a positioning plate 403 having a guide notch 403*a* is supported elastically urged by a plate spring 404, and is slightly movable (FIG. 18). Below the conveyance passage 200 is provided a rocking shaft 406 supported on a support member 405 (FIG. 18) so as to be rocked relative to the member 405. On the rocking shaft 406 is supported one end of a rocking arm 407 bent at its substantially intermediate portion leftwardly of the illustration. To a free end of the rocking arm 407 is attached a movable blade 408 having a guide groove 408*a* (FIG. 17) whose width is a little larger than that of the paper tape 82 and having a cutting blade secured to one side thereof. To one end of the movable blade 408 is fitted a guide roller 409 fittable into said guide notch 403*a*. To a bent portion of the rocking arm 407 is fitted a lever 410, to a free end of the which is fitted a pasting piece 412 elastically urged by a plate spring 411. Over the rocking shaft 406 is fitted a pulley 413 (FIG. 18). On the support block 405 is mounted a motor 414, over a rotation shaft 414*a* of which is fitted a pulley 415 situated opposite to the pulley 413. Between the pulleys 413 and 415 is stretched a belt 416, whereby the rocking arm 407 is rocked through rotation of the motor 414.

In the neighbourhood of the lower support member 405 a paste cartridge 417 (FIG. 16) is rockably provided in a direction indicated by a shown arrow. A tip end 417*a* of the cartridge 417 is situated in the rocking locus of the pasting piece 412 fitted to the rocking arm 407 and is allowed to face the pasting piece 412.

Figure 19:
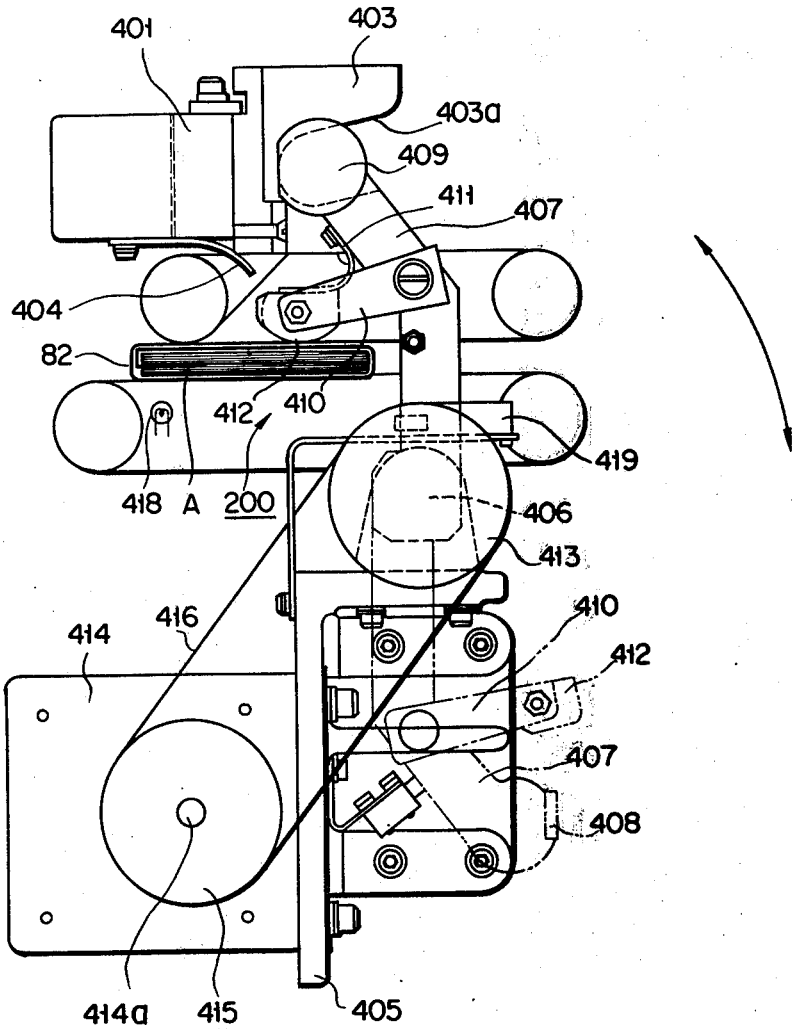
FIG. 19 is a perspective view for explaining the cutting action and pasting action of the paper tape cutting section.

On the conveyance passage 200 is disposed a photoelectric detector 418 such as a solar cell (FIGS. 1B and 19, which is electrically connected to a drive power source (not shown) for driving the conveyance passage 200 and to the motor 414 for driving the rocking arm 407. The detector 418 is designed to detect a position of the normal sheet unit on the conveyance passage 200 to control the respective stop or drive of the conveyance passage 200 and the motor 414. A microswitch 419 shown in FIG. 19 is designed to detect that the rocking arm 407 has been rocked counterclockwise from an illustrated broken line-indicated position to cause the movable blade 408 (FIG. 16) thereof to contact the stationary blade 402 to cut the paper tape 82, thereby to cause a return rotation of the motor 414.

FIG. 20 is a timing chart showing the relation between the device (on)-stop (off) operation of the conveyance passage 200 and the drive (on)-stop (off) operation of the rocking arm 407. In this chart, time is plotted on the abscissa. Namely, when at a point of time TA the conveyance passage 200 is stopped, the rocking arm 407 is rocked during a period of time from TB to TC, and at a point of time TD cuts the paper tape 82, and after the lapse of a time period between TD and TE is returned to the original position. At a point of time TE, the conveyance passage starts to convey the sealed normal sheet unit.

The paper tape cutting means 400 is so constructed that a pasting means for pasting the paper tape 82 bound around the normal sheet unit and a paper tape cutting mechanism may be integrally operated, but arrangement may be so made as to permit only the cutting mechanism to be operated by separately providing another pasting means (not shown) having the same function as that performed by the pasting piece 412 and paste cartridge 417 necessary to the pasting.

The printing or stamping means or section 500 provided on demand is intended automatically to print necessary items on the paper tape 82 of the sealed normal sheet unit A. The normal sheet unit A printed by the printing means 500 is conveyed up to a basket 501 and is received therein.

A normal sheet number-indicating signal and a soiled sheet number-indicating signal supplied from the discriminator circuit 47 of FIG. 2 in accordance with the discrimination results thereof are fed to a normal sheet number totalizer (or counter) 601 and a soiled sheet number totalizer (or counter) 602, respectively, and simultaneously are fed also to be a main control circuit 610. The output of the main control circuit 610 is supplied to a conveyance or transportation control circuit 611, the output of which causes a respective operation of drivers 612, 613 to cause a respective operation of solenoids 614, 615, respectively, said solenoids 614, 615 being designed to operate the above-mentioned gates 55, 56, respectively. The timing with which the gates 55, 56 are operated is controlled by signals supplied to the conveyance control circuit 611 from the light couplers 168*a* (FIG. 1A), 168*b*, 168*c*, and 168*d* (FIG. 1B) and a control signal supplied to the circuit 611 from the main control circuit 610. The control signal from the main control circuit 610 is fed also to a seal or bandage control circuit 616 for controlling the operation of sealing the normal sheet unit A and further to a printer control circuit 617 for controlling the printer section 500.

Figure 21:
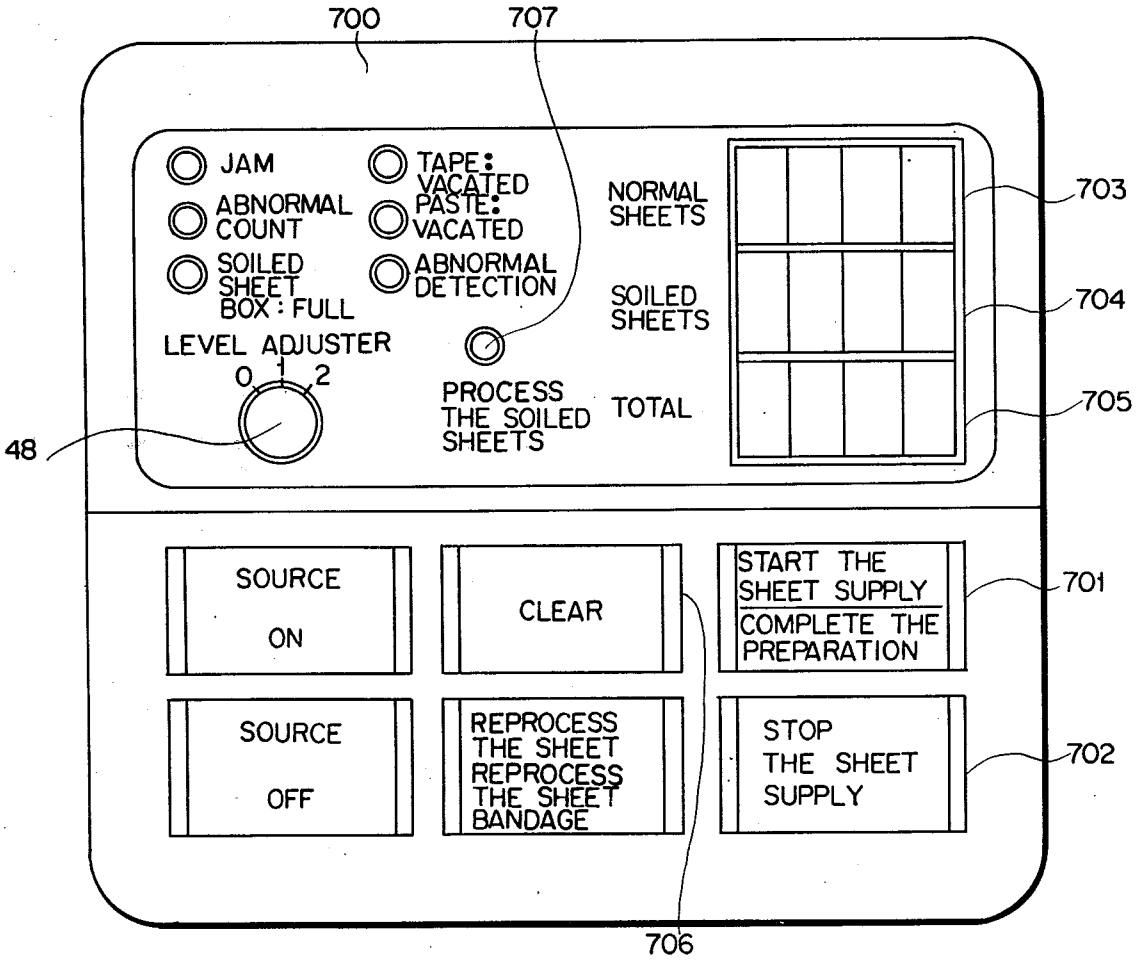
FIG. 21 is a front view of a panel for operating the apparatus shown in FIGS. 1A and 1B.

On an operating panel 700 (FIG. 21) of the paper sheets processing apparatus according to the invention are arranged a paper sheet supply-starting switch 701, a paper sheet supply stopping switch 702, a clear switch 706, a normal sheet number indicator 703, a soiled sheet number indicator 704, a "total number of normal and soiled sheets" indicator 705, and an on- and an off-switch for turning a power source on and off, respectively. On the operating panel 700 there are further provided necessary indication lamps such as those for indicating the abnormality (or JAM) of the apparatus, an abnormal count, a full reception in the soiled sheet box, vacancy of paper tape, vacancy of paste, abnormal detection, or a demand 707 for the processing of soiled sheets. As shown in FIG. 2, to the main control circuit 610 are supplied the output signal of the paper sheet supply-starting switch 701 and also the output signal of the paper sheet supply-stopping switch 702, and resepctive input sides of the counters 601, 602 and 603 are coupled to the discriminator circuit 47. To the counter 601 is supplied a normal sheet-indicating signal. To the counter 602 is supplied a soiled sheet-indicating signal. To the counter 603 are supplied through an OR circuit 708 both said normal sheet-indicating signal and said soiled sheetindicating signal. When, after a first lot of paper sheet has been processed, the paper sheet supply-stopping switch 702 is depressed, the number of normal sheets stored in the normal sheet number counter 601 is indicated through a memory 601M by the normal sheet number indicator 703, the number of soiled sheets stored in the soiled sheet number counter 602 is indicated through a memory 602M by the soiled sheet number indicator 704, the total number of normal and soiled sheets stored in the "respective total numbers of normal and soiled sheets" counter 603 is indicated through a memory 603M by the "total number of normal and soiled sheets" indicator 705.

Next, when a second lot of paper sheets starts to be supplied by depression of the paper sheet supply-starting switch 701, the normal sheet number theretofore stored in the normal sheet number counter 601 and the soiled sheet number theretofore stored in the soiled sheet number counter 704 are respectively cleared with the result that the respective displays of the normal sheet number indicator 703 and the soiled sheet number indicator 704 are also cleared or extinguished. Next, when supply of the paper sheets constituting the seond lot is stopped by depression of the paper sheet supply-stopping switch 702, the normal sheet number indicator 703 and the soiled sheet number indicator 704 indicate the number of normal sheets contained in the second lot and the number of soiled sheets contained in the second lot, respectively. Simultaneously, that total number of normal and soiled sheets contained in the first lot which has theretofore been stored in the counter 603 is cleared, and instead a total number of normal and soiled sheets obtained by adding up the total number of normal and soiled sheets contained in the first lot and the total number of normal and soiled sheets contained in the second lot is indicated through the memory 603M by the "total number of normal and soiled sheets" indicator 705. The output signal from the clear switch 706 clears the sheet number stored in each of the counters 601, 602 and 603 through a clear driver 604.

The construction and function of every section or means of the paper sheets processing apparatus have above been described in detail with reference to the accompanying drawings. Hereinafter, a series of operations of the apparatus are explained. A lot of paper sheets are successively arranged in an erected state in side-by-side relation to each other, and a foremost one of the paper sheets thus arranged is elastically pressed or urged by the elastic member 22, while a rearmost one of those paper sheets is pressed by the support member 23. By driving the vacuum source (not shown), it is allowed to communicate with the adsorption aperture 33 of the rotor 31, and the rotor 31 is rotated in the arrow-indicated direction. Thus, the paper sheets are sequentially drawn out by adsorption one by one from the foremost paper sheet. Each of the paper sheets thus drawn out is transferred onto the ordering plate 34 while being guided by the guide plate 34, and at the same time the adsorption member 32 used to adsorb said each paper sheet is rotated counterclockwise through an angle of 90° and at this rotated position loses its adsorptive force. The belts 36*a* and 36*b* receive the drawn-out paper sheet and sandwich it therebetween to convey it to the detection section 4. Each paper sheet passed through the detection section 4 is subject to detection and discriminated into a normal sheet or a soiled sheet or an unidentifiable sheet. Thereafter, said each paper sheet is sandwiched between the belts 54*a* and 54*b* of the reception and pile-up section 5 and is further conveyed. By counterclockwise rocking the gate 55 the paper sheet not discriminated into any one of normal and soiled sheets is received and piled up in the unidentifiable sheet box 53. By clockwise rocking the gate 53 the paper sheet discriminated into either one of normal and soiled sheets is passed therethrough, and is separated into a normal sheet or into a soiled sheet by the rocking movement of the gate 56 to be further conveyed. Namely, by counterclockwise rocking the gate 56 the normal sheet is received and piled up in the normal sheet box 51, while by clockwise rocking the gate 56 the soiled sheet is sandwiched between the belts 54*a* and 54*d* to be carried into the soiled sheet box 52.

The normal sheet carried into the normal sheet box 51 is received and piled up on the backup plate 57 situated at an elevated or raised position, and is counted by a counter means (not shown). During a period of time in which a prescribed number of normal sheets, for example, one hundred normal sheets, are counted by the counter means, the backup plate 57 is sequentially lowered by the drive motor 15. When one hundred normal sheets are received and piled up on the backup plate 57, the separation lever 61 of the separator means 60 disposed at the rear stage of the normal sheet box 51 is instantaneously rocked clockwise through an angle of 45° to a horizontal position and is stopped. Accordingly, the 101th and the succeeding normal sheets are received and piled up on that separation lever 61. The one hundred normal sheets (hereinafter referred to as a "normal sheet unit A") received and piled up on the backup plate 57 have their respective adjacent two side edges ordered by the vibrators 51*b* and 51*c*. Thereafter, the backup plate 57 is further lowered until its upper face is brought into alignment with the conveyor belt 71*a* of the normal sheet unit sealing means 6, thereby to permit the normal sheet unit A to be transferred onto the belt 71*a*. Thereafter, the backup plate 57 is again raised, and at a position slightly above said horizontal position of the separation lever 61 is stopped. Accordingly, said 101th and the succeeding normal sheets theretofore received and piled up on the separation lever 61 are received on the backup plate 57.

When a unit of the 101st and succeeding normal sheets is transferred from the separation lever 61 to the backup plate 57, the separator means 60 causes the separation lower 61 to be retreated in a state kept horizontal, by causing the rocking arm 62 to be rocked clockwise. The separation lever 61 thus retreated is rocked counterclockwise through an angle of 45° by means of the reset mechanism 63. Thereafter, the rocking arm 62 is rocked counterclockwise and thus advanced toward the normal sheet box 51 to permit the separation lever 61 to be made ready for reception and pile-up thereon of the 301th and the succeeding normal sheets. Namely, the normal sheets conveyed into the normal sheet box 51 are received and piled up therein in a manner separated in units of one hundred sheets, and have their respective two adjacent side edges ordered by the vibrators 51*b* and 51*c*, and are transferred onto the normal sheet unit sealing means 6.

When one hundred soiled sheets are received and piled up in the soiled sheet box 52, the separation lever 64 of the separator means 65 disposed rearwardly of the soiled sheet box 52, as in the case of the reception and pile-up of the normal sheets, is instantaneously rocked clockwise through an angle of 45° and stopped in a state kept horizontal to the entrance of the soiled sheet box 52. Accordingly, the 101st and the succeeding soiled sheets are received and piled up on the separation lever 64 separately from the above-mentioned one hundred soiled sheets (hereinafter referred to as "soiled sheet unit B"). Simultaneously with the time when one hundred soiled sheets (soiled sheet unit B) are separately received and piled up in the soiled sheet box 52, the indication lamp 707 for indicating a demand for the processing of soiled sheets, provided on the operating panel 700 (FIG. 21), is lit. When this lamp 707 is lit, an operator takes out said soiled sheet unit B as separately received and piled up from the soiled sheet box 52 and then depresses a reset switch (not shown) to permit the rocking arm 66 of the separator means 65 to be rocked clockwise for causing the separation lever 64 to be retreated. Thereafter, the separation lever 64 thus retreated is rocked counterclockwise through an angle of 45° by the reset mechanism 67, and then the rocking arm 66 is rocked counterclockwise and advanced toward the soiled sheet box 52. Thus, the separation lever 64 is made ready for reception and pile-up thereon of another one hundred soiled sheets. The foregoing operation of the separator means 65 is completely the same as the corresponding operation of the separator means 60. Where, in spite of the indication lamp 707 being lit, the operator foregets the take-out of the soiled sheet unit B from the soiled sheet box 52 and the reset of the separator means 65, a warning is given by a chime (not shown) and simultaneously the above-mentioned lamp for indicating that the soiled sheet box 52 is full of the soiled sheet unit B is lit. Note here that since, generally, the number of paper sheets being discriminated into soiled sheets is of the order of a value equal to 1/5 of the number of paper sheets being discriminated into normal sheets, a sufficient period of time is given for the operator to take out, after the soiled sheets starts to be received on the separation lever 64, the soiled sheet unit B theretofore received and piled up in the soiled sheet box 52 and depress the above-mentioned reset switch.

Next, when the normal sheet unit A is conveyed in a state sandwiched between the belts 71*a* and 71*b*, a free end portion of the paper tape 82 downwardly suspended between the knife edge 84 and the pin member 86 of the paper tape insertion section 81 provided on the conveyance passage 70 is inserted by the knife edge 84 and the pin member 86 into the normal sheet unit A so as to horizontally divide the same A into upper and lower parts. The normal sheet unit A having the free end portion of the paper tape 82 inserted thereinto is conveyed into the bundling means or section 100. Thereafter, the pin 86 is counterclockwise rocked substantially through an angle of 90° by the rotation mechanism of the solenoid 85 (FIG. 3) to await the return of a free end of the paper tape 82 being cut when that normal sheet unit A is sealed. When the normal sheet unit A is conveyed into the bundling section 100, since the rotation timing pulley 108 (FIG. 5) is rotated by a belt (not shown), the rollers 101*a*, 101*b*, 101*c* and 101*d* of the bundling section 100 are rotated about their respective axes in the arrow-indicated directions of the FIG. 4A, respectively, through the internal gear 106 fixed to the inner housing 107. Accordingly, the normal sheet unit A is sandwiched between a group of the rollers 101*a*, 101*c* and a group of the rollers 101*b*, 101*d* and is sent into a substantially central part of the bundling section 100. When the normal sheet unit A reaches this central part of the bundling section 100 and the rotations of the rollers 101*a* to 101*d* about their respective axes are temporarily stopped, the normal sheet unit A is kept clamped between the rollers 101*a* and 101*b* and between the rollers 101*c* and 101*d*.

Next, the integral revolution timing pulley 105 (FIG. 5) is rotated about its axis by driving a belt (not shown) and simultaneously the rotation timing pulley 108 is also rotated about its axis by driving a belt (not shown) in synchronization with the pulley 105. Then, the internal gear 106 (FIG. 5) rotated by the rotation timing pulley 108 counterclockwise of FIG. 6 through the support bed 103 and the gears 102*a*, 102*b*, 102*c*, and 102*d* subject to integral revolution through the coupling shaft 104 are rotated in a state kept intermeshed with each other prior to this rotation. Namely, the rollers 101*a*, 101*b*, 101*c*, and 101*d* are integrally revolved in a state clamping the normal sheet unit A as shown in FIG. 4B. When these rollers are integrally revolved a prescribed number of times, for example, twice, the normal sheet unit A is twice wound with the paper tape 82. Next, the integral revolution timing pulley 105 is stopped and locked, and under this condition only the rotation timing pulley 108 is rotated about its axis. Then, the integral revolution of the rollers 101*a*, 101*b*, 101*c* and 101*d* is stopped and these rollers are rotated about their respective axes (FIG. 4C). As a result, the normal sheet unit A is transferred to the conveyance passage 200 adjacent to the bundling section 200 to be further conveyed by being sandwiched between the belts 201*a* 201*b* of the conveyance passage 200.

In the bundling section 100, in order to permit the rollers 101*a* to 101*d* to be not only rotated about their respective axes but also integrally revolved, a timing belt is stretched over the rotation timing pulley and the integral revolution timing pulley thereby to transmit a rotation force to these pulleys from a drive source. But this invention is not limited to such timing belts, and such rotation force transmission means may be of any mechanism capable of permitting a synchronous transmission of a rotation force to those pulleys. Further, the number of the rollers is not limited to four, either.

Figure 17:
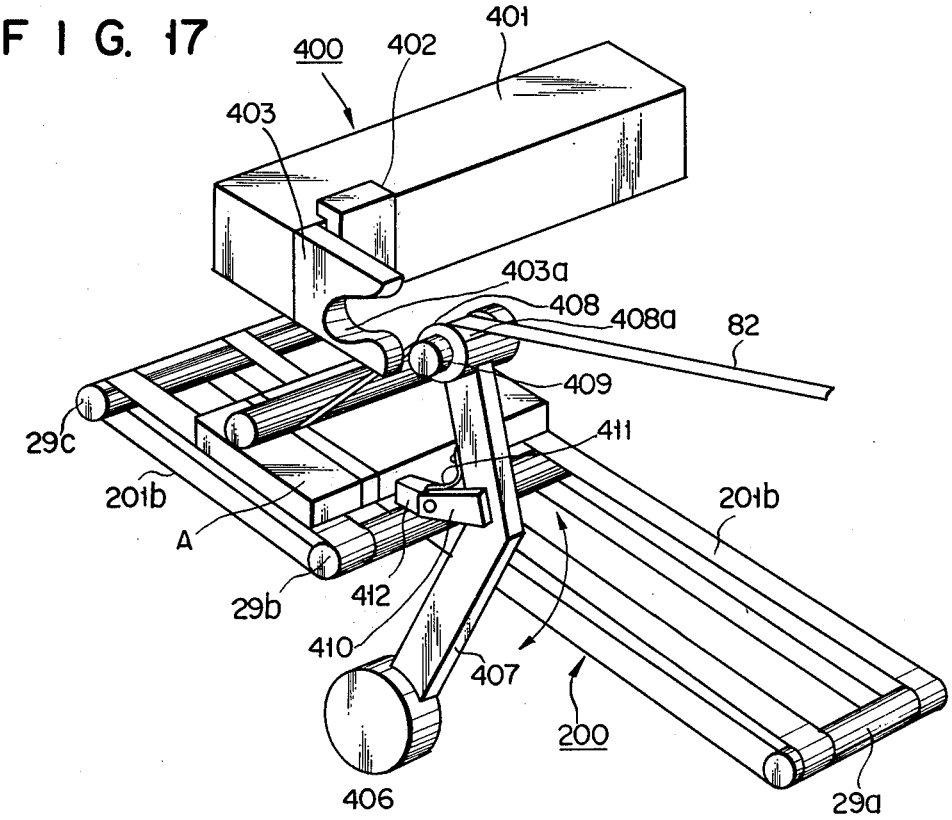
FIG. 17 is an enlarged perspective view of the paper tape cutting section of FIG. 16.
Figure 16:
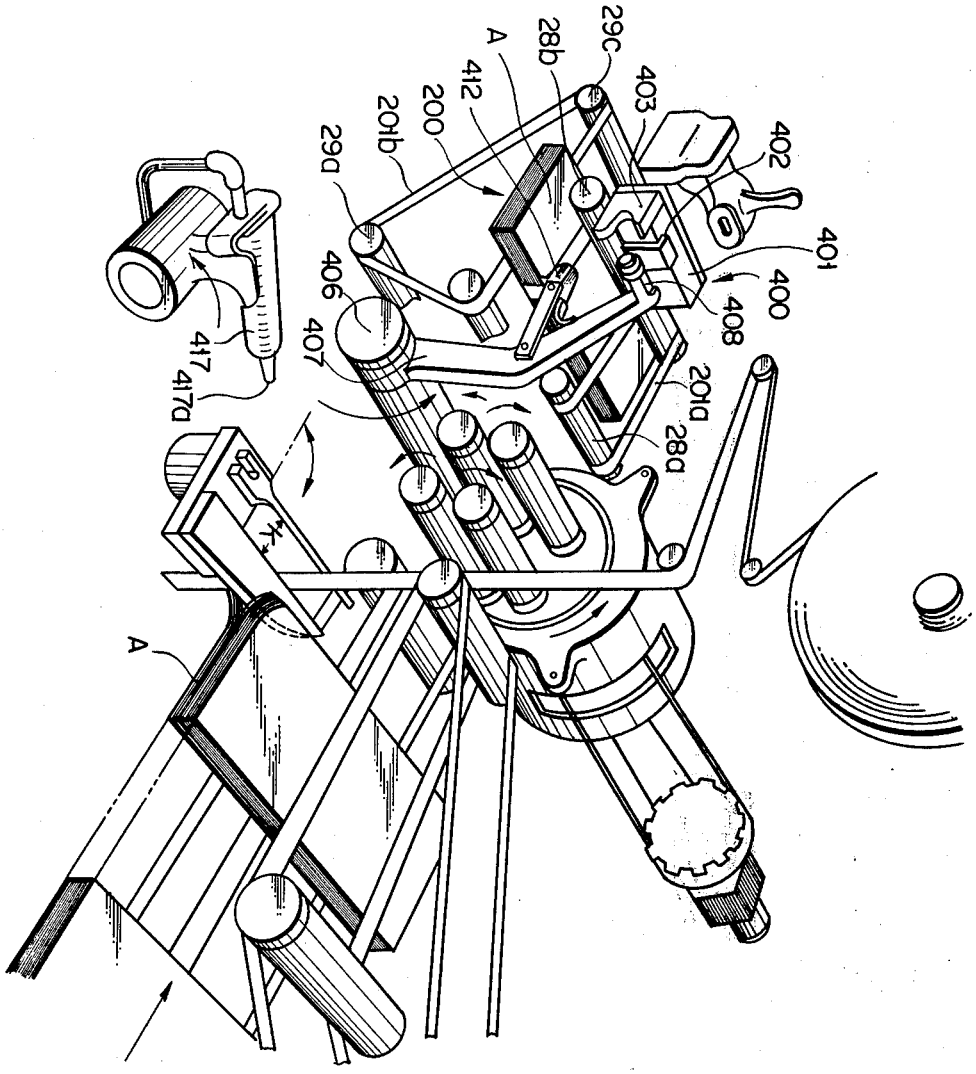
FIG. 16 is a perspective view showing the positional relation among the paper tape insertion section, bundling section, pasting section, and paper tape cutting section of FIG. 1B.

The normal sheet unit A sent onto the conveyance passage 200 is subjected, by the paper tape cutting means 400 disposed substantially at a central part of the conveyance passage 200, to the pasting of its paper tape 82 and the cutting of this pasted paper tape to separate it from the paper tape supply source. Namely, when the normal sheet unit A arrives at a prescribed position of the conveyance passage 200, the detector 418 (FIGS. 1 and 18) detects a tip end of that normal sheet unit A to sent a stop signal to a drive source for driving the conveyance passage 200 and simultaneously send an operating signal to the motor 414. Accordingly, the normal sheet unit A is stopped on the passage 200, and the rocking shaft 406, as shown in FIG. 19, is rocked counterclockwise through the pulleys 415, 413 and the belt 416. When, as shown in FIG. 17, the rocking arm 407 is rocked counterclockwise and the movable blade 408 reaches the position at which the paper tape 82 is suspended, this paper tape 82 is scooped by the guide groove 408*a* (FIG. 17). This prevents the paper tape 82 from being disengaged from the movable blade 408 due to the paper tape 82 being laterally displaced. When the movable blade 408 comes nearer to the stationary blade 402 (FIG. 16), the guide roller 409 (FIG. 17) provided for the movable blade 408 is first guided into the guide notch 403*a* of the positioning plate 403 and then, after the position of the movable blade 408 is defined by that guide notch 403*a*, the movable blade 408 is brought into collision with the stationary blade 402, whereby the paper tape 82 is cut. Namely, the positioning plate 403 is so disposed as to be made integral with the stationary blade 402, but is attached to the support block 401 so as to slightly move relatively thereto and yet is elastically urged or pressed by the plate spring 404. For this reason, even if, upon cutting the paper tape, the rocking arm 407 is slightly bent to cause a slight displacement of the movable blade 408 from the stationary blade 402, this displacement will be removed when the guide roller 409 is guided by the guide notch 403*a*, to permit both blades to return to normal position. Further, when a large load is applied to the guide roller 409 and also to the guide notch 403*a*, the guide roller 409 causes the positioning plate 403 to move against the restoring force of the plate spring 404 (FIG. 18), so that the stationary blade 402 is kept always constant relatively to the position of the movable blade 408.

Since, at the time when the tape cutting is performed as above described, the pasting piece 412 (FIGS. 16 and 18) provided for the rocking arm 407 is allowed to slide along the surface of the paper tape 82 bound about the normal sheet unit A, the paste previously applied or coated onto the surface of the pasting piece 412 is adhered onto the surface of the paper tape 82. When, in this way, the cutting of the paper tape 82 and the pasting of the paper tape are completed, the microswitch 419 (FIG. 19) is energized and a return rotation command signal is sent from the microswitch 419 to the motor 414 and an operating signal is sent to the drive source of the conveyance passage 200. As a result, the normal sheet unit A is further conveyed in a state sandwiched between the belts 201*a* and 201*b*. Since, upon this conveyance, a cut end portion of the paper tape wound around the normal sheet unit A is joined to said paste-adhered portion of the paper tape and then pressed thereto, the normal sheet unit A is completely sealed.

On the other hand, the rocking arm 407 is rocked clockwise by the return rotation of the motor 414 to return to the original position (indicated in a two-dot chain line) and is stopped. Since, however, as shown in FIG. 20, the travel of the belts 201a, 201b of the conveyance passage 200 is kept timed with the rocking movement of the rocking arm 407, this rocking arm 407 is prevented from colliding with the normal sheet unit A. With the clockwise rocking movement of the rocking arm 407, the awaiting paste cartridge 417 (FIG. 16) is rocked in a direction indicated by a shown arrow and a paste is ejected from the tip end 417*a* of the cartridge 417 and is applied or coated onto the pasting piece 412. Further, an end portion of the paper tape 82 on the side of the reel 87 goes away from the movable blade 408 and is again downwardly suspended into the interspace K between the knife edge 84 and the pin member 86 and is made ready for the bundling of a next coming normal sheet unit A. In this way, the normal sheet unit conveyed over in sequence from the normal sheet box 51 can automatically be bundled and sealed. The width of the pasting piece 412 is chosen to be a little narrower than the width of the paper tape 82. Upon sealing the normal sheet unit A, therefore, a paste applied to the paper tape is prevented from overflowing the tape. The normal sheet unit A thus sealed is sent on demand into the printing or stamping section 500, and necessary items are printed onto the surface of the paper tape 82. Thereafter, the resultant normal sheet unit A is received on the basket 501 installed exteriorly of the main body 1.

We claim:

1. A paper sheets processing apparatus comprising:

a draw-out and conveyance section for drawing out one by one a paper sheet from the paper sheets arranged in a laminated state and conveying said paper sheet;

a detection section provided at a terminal end of said draw-out and conveyance section to detect each paper sheet conveyed to said detection section thereby to discriminate said each paper sheet into a normal sheet or a soiled sheet;

a reception and pile-up section for receiving and piling up each discriminated paper sheet in a corresponding one of normal sheet and soiled sheet reception and pile-up boxes through a gate;

a means for separating said normal sheets in units of a prescribed number of sheets to permit them to be piled up;

a bundling member supply means for supplying a bundling member for bundling each unit of the normal sheets piled up in units of said prescribed number of sheets;

a bundling means including a pair of roller groups each having at least two rollers, a rotation mechanism for permitting rotation of each roller about the axis thereof, and an integral revolution mechanism for permitting integral revolution of said pair of roller groups, whereby said normal sheet unit is sandwiched between said pair of roller groups by said rotation mechanism, and said bundling member is wound a prescribed number of times around said normal sheet unit by said integral revolution mechanism.

2. A paper sheets processing apparatus according to claim 1, wherein said bundling means includes:

a rotation shaft rotatably supported at a smaller opening section of a funnel-shaped stationary outer housing and connected to a first driving means;

a funnel-shaped inner housing which, within a layer opening section of said outer housing, has its smaller opening section rotatably supported by said rotation shaft and connected to a second driving means and has an internal gear at its larger opening section;

a roller shaft-supporting means fixed to a free end of said rotation shaft within said larger opening section of said inner housing;

first to fourth rollers having their respective shafts rotatably supported by said roller shaft-supporting means;

a second gear fixed to the shaft of said second roller and intermeshed with said internal gear and intermeshed with a first gear fixed to the shaft of said first roller; and a fourth gear fixed to the shaft of said fourth roller and intermeshed with said internal gear and intermeshed with a third gear fixed to the shaft of said third roller, whereby said first to fourth rollers are each rotated about its axis by drive of said second driving means, and are integrally revolved by drive of said first driving means.

3. A paper sheets processing apparatus according to claim 2, where said first to fourth rollers are each covered by an elastic member having a great coefficient of friction.

4. A paper sheets processing apparatus according to claim 2, which further comprises a first belt stretched between said first and third rollers and a second belt stretched between said second and fourth rollers.

5. A paper sheets processing apparatus according to claim 1, wherein said bundling means includes:

a first rotation shaft rotatably supported at a smaller opening section of a funnel-shaped stationary outer housing and connected to a first driving means;

a roller shaft-supporting means fixed to said first rotation shaft within a layer opening section of said outer housing;

first to fourth rollers having their respective shafts rotatably supported by said roller shaftsupporting means;

a second gear intermeshed with a first gear fixed to the shaft of said first roller and fixed to the shaft of said second roller;

a fourth gear intermeshed with a third gear fixed to the shaft of said third roller and fixed to the shaft of said fourth roller;

a first auxiliary gear fixed to the shaft of said first roller and a second auxiliary gear fixed to the shaft of said third roller;

a second rotation shaft connected to a second driving means and rotatably supported within said first rotation shaft and extended up to a position of said first and second auxiliary gears; and a third auxiliary gear fixed to a free end of said second rotation shaft and intermeshed with a respective one of said first and second auxiliary gears, whereby said first to fourth rollers are each rotated about its axis when driven by said second driving means, and are integrally revolved when driven by said first driving means.

6. A paper sheets processing apparatus according to claim 1, wherein said means for separating said normal sheets in units of a prescribed number of sheets to permit them to be piled up includes: a first separator means disposed at a rear stage of said normal sheet box and having a separation lever; and a back and up plate for receiving said normal sheets piled up on said separation lever, and being lowered when said normal sheets are piled up in said prescribed number, to supply said prescribed number of normal sheets to a succeeding stage conveyance passage.

7. A paper sheets processing apparatus according to claim 6, wherein said normal sheet box includes at least one vibration plate for giving a vibration to edges of said normal sheets received and piled up on said back and up plate thereby to order said edges.

8. A paper sheets processing apparatus according to claim 1, wherein said bundling member supply means includes:

a bundling member supply reel; and a knife edge and pin member disposed in a conveyance passage for conveying said normal sheets unit up to said bundling means, whereby a free end portion of said bundling member supplied from said reel is downwardly suspended between said knife edge and said pin member, and said knife edge and pin member are so disposed that the former horizontally separates said normal sheet unit conveyed thereto into upper and lower parts and the latter inserts said free end portion of said bundling member into an interspace between said upper and lower parts of said normal sheet unit placed under conveyance.

9. A paper sheets processing apparatus according to claim 1, which further comprises:

a conveyance passage for receiving said bundled normal sheet unit to convey it further;

an adhesive applying means for applying adhesive onto said bundling member bundling said normal sheet unit on the conveyance passage; and a bundling member cutting means for cutting away an adhesive-applied portion of said bundling member from said bundling member supply means.

10. A paper sheets processing apparatus according to claim 9, wherein said adhesive applying means includes:

a rocking arm driven when said bundled normal sheet unit arrives at a prescribed position of said conveyance passage;

an elastic member fitted to said rocking arm and, when said rocking arm is rocked, contacting said bundling member wound around said normal sheet unit to apply an adhesive thereto; and an adhesive supply means for, when said rocking arm is rocked, supplying an adhesive to said elastic member.

11. A paper sheets processing apparatus according to claim 9, wherein said bundling member cutting means includes:

a stationary blade;

a rocking arm driven when said bundled normal sheet unit arrives at a prescribed position of said conveyance passage;

a guide member provided at a free end of said rocking arm and, when said rocking arm is driven, guiding said bundling member up to a position of said stationary blade; and a movable blade provided at a free end of said rocking arm and sandwiching said bundling member guided between itself and said stationary blade to cut the same.

12. A paper sheets processing apparatus according to claim 9, wherein said adhesive applying means and bundling member cutting means include:

a rocking arm driven when said bundled normal sheet unit arrives at a prescribed position of said conveyance passage; and an elastic member for, when said rocking arm is driven, contacting said bundling member wound around said normal sheet unit to give an adhesive to it, a guide member for guiding said bundling member to a cutting position, and a movable blade for cutting said bunding member guide, said elastic member, guide member and movable blade being fitted to said rocking arm, respectively, whereby the application of an adhesive to said bundling member wound around said normal sheet unit and the cutting of said bundling member are performed simultaneously.

13. A paper sheets processing apparatus according to claim 1, which further includes a second separator means disposed at a rear stage of said soiled sheet box to separate said soiled sheets being received and piled up therein in units of a prescribed member of sheets to permit them to be piled up in said soiled sheet box.

14. A paper sheets processing apparatus according to claim 2, wherein during a period of time in which said normal sheet unit is sandwiched between a roller group consisting of said first and third rollers and another roller group consisting of said second and fourth rollers, said first and second driving means are driven in synchronization with each other.

* * * * *